US005389484A

United States Patent [19]

Hagiwara et al.

[11] Patent Number: 5,389,484

[45] Date of Patent: Feb. 14, 1995

[54] TONER FOR DEVELOPING ELECTROSTATIC IMAGES, IMAGE FORMING APPARATUS, APPARATUS UNIT AND FACSIMILE APPARATUS

[75] Inventors: Kazuyoshi Hagiwara, Tokyo; Hirohide Tanikawa, Yokohama, both of Japan

[73] Assignee: Canon Kabushiki Kaisha, Tokyo, Japan

[21] Appl. No.: 197,555

[22] Filed: Feb. 17, 1994

Related U.S. Application Data

[63] Continuation of Ser. No. 868,966, Apr. 16, 1992, abandoned.

[30] Foreign Application Priority Data

| | | | |
|---|---|---|---|
| Apr. 16, 1991 | [JP] | Japan | 3-109684 |
| Apr. 26, 1991 | [JP] | Japan | 3-097245 |
| Mar. 31, 1992 | [JP] | Japan | 4-077447 |
| Apr. 13, 1992 | [JP] | Japan | 4-118496 |

[51] Int. Cl.[6] ..... G03G 9/00

[52] U.S. Cl. ..... 430/109; 430/110; 430/904

[58] Field of Search ..... 430/109, 110, 904

[56] References Cited

U.S. PATENT DOCUMENTS

| | | | |
|---|---|---|---|
| 2,297,691 | 4/1939 | Carlson . | |
| 4,985,327 | 1/1991 | Sakashita et al. | 430/106.6 |

FOREIGN PATENT DOCUMENTS

| | | |
|---|---|---|
| 55-90509 | 7/1980 | Japan . |
| 57-178249 | 11/1982 | Japan . |
| 57-178250 | 11/1982 | Japan . |
| 58-173752 | 10/1983 | Japan . |
| 58-173756 | 10/1983 | Japan . |
| 60-4946 | 1/1985 | Japan . |
| 63-214760 | 9/1988 | Japan . |
| 63-217362 | 9/1988 | Japan . |
| 63-217363 | 9/1988 | Japan . |

*Primary Examiner*—Marion E. McCamish
*Assistant Examiner*—Laura Weiner
*Attorney, Agent, or Firm*—Fitzpatrick, Cella, Harper & Scinto

[57] ABSTRACT

A toner for developing electrostatic images has a binder resin having as a constituent an acid component with an acid value of from 0.5 mg.KOH/g to 100 mg.KOH/g, a colorant, and at least one of compounds represented by Formulas (I), (II) and (III).

40 Claims, 2 Drawing Sheets

TONER FOR DEVELOPING ELECTROSTATIC IMAGES, IMAGE FORMING APPARATUS, APPARATUS UNIT AND FACSIMILE APPARATUS

This application is a continuation of application Ser. No. 07/868,966, filed Apr. 16, 1992, now abandoned.

BACKGROUND OF THE INVENTION

1. Field of the invention

The present invention relates to a toner for developing electrostatic images, used in electrophotography, electrostatic printing or electromagnetic recording and suited for heat fixing. It also relates an image forming apparatus and a facsimile apparatus that make use of such a toner.

2. Related Background Art

A number of methods as disclosed in U.S. Pat. No. 2,297,691, Japanese Patent Publications No. 42-23910 and No. 43-24748 and so forth are conventionally known for electrophotography. In general, copies are obtained by forming an electrostatic latent image on a photosensitive member by utilizing a photoconductive material and by various means, subsequently developing the latent image by the use of a toner, and transferring the toner image to a recording medium such as paper if necessary, followed by fixing by the action of heat, pressure or solvent vapor.

Various methods or apparatus have been developed in relation to the above final step, i.e., the step of fixing the toner image to a sheet-like recording medium such as paper. A method most commonly available at present is the pressure heating system making use of a heating roller.

The pressure heating system making use of a heating roller is a method of carrying out fixing by causing a recording medium to pass over a heating roller whose surface is formed of a material having a releasability to toner while a toner image surface of the former is brought into contact with the surface of the latter under application of a pressure. Since in this method the surface of the heating roller comes into contact with the toner image of the recording medium under application of a pressure, a very good thermal efficiency can be achieved when the toner image is melt-adhered onto the recording medium, so that fixing can be carried out rapidly. This method is therefore very effective in high-speed electrophotographic copying machines. In this method, however, since the surface of the heating roller comes into contact with the toner image under application of a pressure in the latter's molten state, part of the toner image may adhere and transfer to the surface of the fixing roller, which may re-transfer to the subsequent recording medium to cause an offset phenomenon, resulting in a contamination of the recording medium. Thus, it is essential in the heating roller fixing system that no toner is adhered to the surface of the heat fixing roller.

For the purpose of not causing the toner to adhere to the surface of a fixing roller, a measure has been hitherto taken such that the roller surface is formed of a material such as silicone rubber or a fluorine resin, having an excellent releasability to toner, and, in order to prevent offset and to prevent fatigue of the roller surface, its surface is further covered with a thin film formed using a fluid having a good releasability as exemplified by silicone oil. However, this method, though effective in view of the prevention of the offset of toner, requires a device for feeding an anti-offset fluid, and hence has the problem that the fixing device becomes complicated.

Hence, it is not preferable to prevent offset by feeding the anti-offset fluid and, under existing circumstances, it is sought to make an advancement on a toner having a broad fixing temperature range and high anti-offset properties. Now, a method has been taken in which a wax such as a low-molecular weight polyethylene or a low-molecular weight polypropylene capable of melting well upon heating is added in the toner so that the toner can have an improved releasability. Its addition can be effective for preventing offset, but on the other hand the wax tends to cause a lowering of durability because agglomerating properties of the toner may increase and charge performance thereof may become unstable. Various attempts have been made on improving binder resins.

For example, a method is known in which, in order to prevent offset, a binder resin for a toner is made to have a higher glass transition temperature (Tg) or molecular weight so that the toner can have an improved melt viscoelastisity. However, an attempt to improve anti-offset by such a method may bring about an unsatisfactory fixing performance to cause the problem that the fixing performance in a low-temperature environment, i.e., low-temperature fixing performance, that is required of high-speed copying machines and energy saving may become poor.

In order to improve the fixing performance of toners, it is necessary to decrease the viscosity of toner at the time of melting so that the toner has a large contact area with respect to a fixing substrate. For this reason, it is required for the binder resin used therein to have a low Tg and molecular weight.

That is, the low-temperature fixing performance and the anti-offset are contradictory in one aspect, and hence it is very difficult to give a toner that can satisfy these functions at the same time.

To solve this problem, Japanese Patent Publication No. 51-23354, for example, discloses a toner comprising a vinyl polymer cross-linked at an appropriate degree by adding a cross-linking agent and a molecular weight modifier. A number of proposals are also made on blend toners wherein Tg, molecular weight and gel content are controlled in combination in vinyl polymers.

Toners containing such a cross-linked vinyl polymer or a gel component can certainly improve anti-offset properties.

However, when they are incorporated into the toner, use of this cross-linked vinyl polymer as a material for toner provides very great internal friction in the polymer when materials are melt-kneaded during the preparation of toner, where a large shear force is applied to the polymer. Hence, in many instances, molecular chains are cut which cause a decrease in melt viscosity, so that the anti-offset properties are adversely affected.

Now, as measures to solve this problem, Japanese Patent Applications Laid-open No. 55-90509, No. 57-178249, No. 57-178250 and No. 60-4946 disclose that a resin containing a carboxylic acid and a metal compound are used as materials for a toner, which are heated and reacted when melt-kneaded, to form a cross-linked polymer incorporated into the toner.

Japanese Patent Applications Laid-open No. 63-214760, No. 63-217362 and No. 63-217363 also disclose that a vinyl monomer, a vinyl resin having a specific half ester compound as an essential component unit, and a polyvalent metal compound are allowed to react to effect cross-linking.

Japanese Patent Applications Laid-open No. 63-214760, No. 63-217362 and No. 63-217363 also disclose that molecular weight distribution of the resin is separated into two groups comprised of a low-molecular weight and a high-molecular weight fraction, where a carboxyl group of a specific half ester compound contained in the low-molecular weight side is reacted with a polyvalent metal ion.

In proposals in these disclosures, however, carboxylic acids and metal compounds are used as starting materials so as to form cross-links. Many of these materials have a strong, negative chargeability or if a weak, negative chargeability, they have a strong negative chargeability in a decomposition product formed as a result of the cross-linking reaction. Accordingly, although they are effective for negatively chargeable toners, they are not preferable in many respects such that a decrease in density and fogging occurs when they are used in positively chargeable toners.

Thus, effective incorporation of the cross-linked polymer and gel component into toners requires use of materials with negative chargeability and, under existing circumstances, it is sought to provide a cross-linking material suited for positively chargeable toners.

Moreover, the toners proposed in these disclosures have not satisfied the performances required of toners, in particular, the anti-offset properties required for high-speed machines. For example, in high-speed machines making copies of 80 or more sheets per minute, no satisfactory fixing performance can be achieved and there is another problem that recording mediums are stained by the toner which flows out of a cleaning member provided in contact with a fixing roller.

More specifically, in such high-speed machines making copies of 80 or more sheets per minute, the offset material on the fixing roller amounts to a considerable quantity because of an enormous number of paper feed, even though the quantity of offset per sheet is very small. This may cause troubles for fixing assemblies. In order to remove this small quantity of offset matters, a fixing-roller cleaning member such as a cleaning roller or web made of silicone rubber is fitted in contact with a fixing roller. Conventional binder resins for toners are mainly so designed as to accomplish low-temperature fixing performance and anti-offset, and not so designed as to maintain a high melt viscosity to a temperature as high as 200° C. or above. Hence, the toner components having adhered to the fixing-roller cleaning member developed a low melt viscosity because of their residence thereon for a long time at the temperature set for the fixing roller. Moreover, in an instance in which the temperature of the fixing roller has overshot the temperature set for the fixing roller when, e.g., a copying machine is switched on, the fixing roller develops a temperature of 200° C. or above to cause an extreme decrease in the melt viscosity of adhering toner components, which are again transferred to the fixing roller to stain recording mediums.

SUMMARY OF THE INVENTION

An object of the present invention is to provide a toner for developing electrostatic images, an image forming apparatus, an apparatus unit and a facsimile apparatus that have solved the above problems.

Another object of the present invention is to provide a toner for developing electrostatic images, capable of obtaining fog-free, high density images not only in the case of negatively chargeable toners but also in the case of positively chargeable toners, without damage of fixing performance and anti-offset properties; and an image forming apparatus, an apparatus unit and a facsimile apparatus that make use of such a toner.

Still another object of the present invention is to provide a toner for developing electrostatic images, capable of being less influenced by environmental variations and obtaining good images even in both a low-humidity environment and a high-humidity environment; and an image forming apparatus, an apparatus unit and a facsimile apparatus that make use of such a toner.

A further object of the present invention is to provide a toner for developing electrostatic images, capable of preventing all or only a little toner from flowing out of a cleaning means for a fixing assembly.

A still further object of the present invention is to provide a toner for developing electrostatic images, capable of stably obtaining good images even in high-speed machines and thus requiring no choice of the types of machines to which it is applied; and an image forming apparatus, an apparatus unit and a facsimile apparatus that make use of such a toner.

The present invention provides a toner for developing electrostatic images, comprising;

a binder resin having as a constituent an acid component with an acid value of from 0.5 mg.KOH/g to 100 mg.KOH/g, a colorant, and at least one of compounds represented by the following Formulas (I), (II) and (III).

Formula (I)

$$R_1HN\text{-}Ar\text{-}NHR_2$$

wherein Ar represents an aryl group which may have a substituent; and $R_1$ and $R_2$ may be the same or different and each represent a hydrogen atom, an alkyl group or a phenyl group which may have a substituent, and at least one of them may combine with Ar to form a nitrogen-containing ring structure or both of them may combine with each other to form a nitrogen-containing ring structure.

Formula (II)

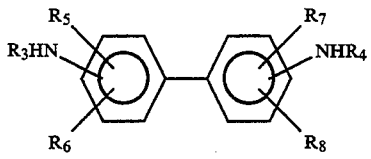

wherein $R_3$ and $R_4$ may be the same or different and each represent a hydrogen atom, an alkyl group or a phenyl group which may have a substituent; and $R_5$, $R_6$, $R_7$ and $R_8$ may be the same or different and each represent a hydrogen atom, an alkyl group, a hydroxyl group, an alkoxyl group, a mercapto group, an alkylthio group, an amino group, an alkylamino group, a dialkylamino group, a halogen atom, a phenyl group which may have a substituent, or an alkenyl group, $R_5$ and $R_6$ may combine with each other to form a nitrogen-containing ring structure, and $R_7$ and $R_8$ may combine with each other to form a nitrogen-containing ring structure.

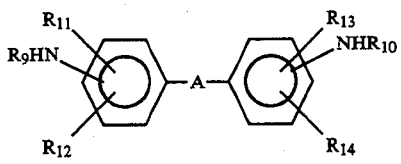

Formula (III)

wherein A represents a linking group; $R_9$ and $R_{10}$ may be the same or different and each represent a hydrogen atom, an alkyl group or a phenyl group which may have a substituent; and $R_{11}$, $R_{12}$, $R_{13}$ and $R_{14}$ may be the same or different and each represent a hydrogen atom, an alkyl group, a hydroxyl group, an alkoxyl group, a mercapto group, an alkylthio group, an amino group, an alkylamino group, a dialkylamino group, a halogen atom, a phenyl group which may have a substituent, or an alkenyl group, $R_{11}$ and $R_{12}$ may combine with each other to form a nitrogen-containing ring structure, and $R_{13}$ and $R_{14}$ may combine with each other to form a nitrogen-containing ring structure.

The present invention also provides an image forming apparatus comprising;

an electrostatic image bearing member which bears an electrostatic image on its surface;

a charging means for electrostatically charging said electrostatic image bearing member;

a developing means for developing the electrostatic image carried on said electrostatic image bearing member;

a transfer means for transferring the toner image formed by said developing means, to a recording medium;

a cleaning means for removing deposits on said electrostatic image bearing member; and a fixing means for fixing the toner image transferred to said recording medium, by the action of heat and pressure;

wherein said developing means comprises a toner for developing electrostatic images, comprising a binder resin having as a constituent an acid component with an acid value of from 0.5 mg.KOH/g to 100 mg.KOH/g, a colorant, and at least one of compounds represented by the following Formulas (I), (II) and (III).

Formula (I)

$R_1HN\text{-}Ar\text{-}NHR_2$ wherein Ar represents an aryl group which may have a substituent; and $R_1$ and $R_2$ may be the same or different and each represent a hydrogen atom, an alkyl group or a phenyl group which may have a substituent, and at least one of them may combine with Ar to form a nitrogen-containing ring structure or both of them may combine with each other to form a nitrogen-containing ring structure.

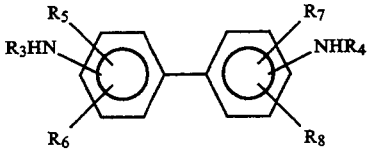

Formula (II)

wherein $R_3$ and $R_4$ may be the same or different and each represent a hydrogen atom, an alkyl group or a phenyl group which may have a substituent; and $R_5$, $R_6$, $R_7$ and $R_8$ may be the same or different and each represent a hydrogen atom, an alkyl group, a hydroxyl group, an alkoxyl group, a mercapto group, an alkylthio group, an amino group, an alkylamino group, a dialkylamino group, a halogen atom, a phenyl group which may have a substituent, or an alkenyl group, $R_5$ and $R_6$ may combine with each other to form a nitrogen-containing ring structure, and $R_7$ and $R_8$ may combine with each other to form a nitrogen-containing ring structure.

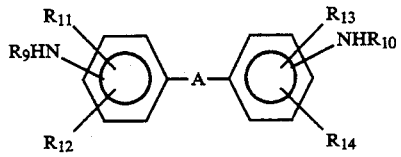

Formula (III)

wherein A represents a linking group; $R_9$ and $R_{10}$ may be the same or different and each represent a hydrogen atom, an alkyl group or a phenyl group which may have a substituent; and $R_{11}$, $R_{12}$, $R_{13}$ and $R_{14}$ may be the same or different and each represent a hydrogen atom, an alkyl group, a hydroxyl group, an alkoxyl group, a mercapto group, an alkylthio group, an amino group, an alkylamino group, a dialkylamino group, a halogen atom, a phenyl group which may have a substituent, or an alkenyl group, $R_{11}$ and $R_{12}$ may combine with each other to form a nitrogen-containing ring structure, and $R_{13}$ and $R_{14}$ may combine with each other to form a nitrogen-containing ring structure.

The present invention also provides an apparatus unit comprising;

an electrostatic image bearing member which bears an electrostatic image on its surface;

a charging means for electrostatically charging said electrostatic image bearing member; and a developing means for developing the electrostatic image carried on said electrostatic image bearing member;

a transfer means for transferring the toner image formed by said developing means, to a recording medium;

a cleaning means for removing deposits on said electrostatic image bearing member; and a fixing means for fixing the toner image transferred to said recording medium, by the action of heat and pressure;

at least one of said electrostatic image bearing member, said charging means and said cleaning means being held as one unit together with said developing means, and said one unit being detachably provided in the body of an apparatus having said transfer means, said fixing means and any member or means not held in said one unit;

wherein said developing means comprises a toner for developing electrostatic images, comprising a binder resin having as a constituent an acid component with an acid value of from 0.5 mg.KOH/g to 100 mg.KOH/g, a colorant, and at least one of compounds represented by the following Formulas (I), (II) and (III).

Formula (I)

$R_1HN\text{-}Ar\text{-}NHR_2$ wherein Ar represents an aryl group which may have a substituent; and $R_1$ and $R_2$ may be the same or different and each represent a hydrogen atom, an alkyl group or a phenyl group which may have a substituent, and at least one of them may combine with Ar to form a nitrogen-containing ring structure or both of them may combine with each other to form a nitrogen-containing ring structure.

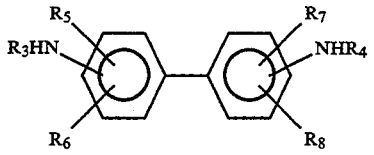

Formula (II)

wherein $R_3$ and $R_4$ may be the same or different and each represent a hydrogen atom, an alkyl group or a phenyl group which may have a substituent; and $R_5$, $R_6$, $R_7$ and $R_8$ may be the same or different and each represent a hydrogen atom, an alkyl group, a hydroxyl group, an alkoxyl group, a mercapto group, an alkylthio group, an amino group, an alkylamino group, a dialkylamino group, a halogen atom, a phenyl group which may have a substituent, or an alkenyl group, $R_5$ and $R_6$ may combine with each other to form a nitrogen-containing ring structure, and $R_7$ and $R_8$ may combine with each other to form a nitrogen-containing ring structure.

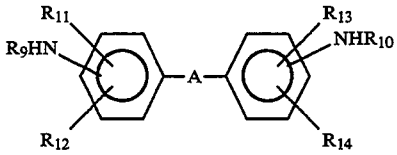

Formula (III)

wherein A represents a linking group; $R_9$ and $R_{10}$ may be the same or different and each represent a hydrogen atom, an alkyl group or a phenyl group which may have a substituent; and $R_{11}$, $R_{12}$, $R_{13}$ and $R_{14}$ may be the same or different and each represent a hydrogen atom, an alkyl group, a hydroxyl group, an alkoxyl group, a mercapto group, an alkylthio group, an amino group, an alkylamino group, a dialkylamino group, a halogen atom, a phenyl group which may have a substituent, or an alkenyl group, $R_{11}$ and $R_{12}$ may combine with each other to form a nitrogen-containing ring structure, and $R_{13}$ and $R_{14}$ may combine with each other to form a nitrogen-containing ring structure.

The present invention still also provides a facsimile apparatus comprising an electrophotographic apparatus and a receiver means for receiving image information from a remote terminal;

said electrophotographic apparatus comprising;

an electrostatic image bearing member which bears an electrostatic image on its surface;

a charging means for electrostatically charging said electrostatic image bearing member;

a developing means for developing the electrostatic image carried on said electrostatic image bearing member;

a transfer means for transferring the toner image formed by said developing means, to a recording medium;

a cleaning means for removing deposits on said electrostatic image bearing member; and a fixing means for fixing the toner image transferred to said recording medium, by the action of heat and pressure;

wherein said developing means comprises a toner for developing electrostatic images, comprising a binder resin having as a constituent an acid component with an acid value of from 0.5 mg.KOH/g to 100 mg.KOH/g, a colorant, and at least one of compounds represented by the following Formulas (I), (II) and (III).

Formula (I)

$R_1HN\text{-}Ar\text{-}NHR_2$ wherein Ar represents an aryl group which may have a substituent; and $R_1$ and $R_2$ may be the same or different and each represent a hydrogen atom, an alkyl group or a phenyl group which may have a substituent, and at least one of them may combine with Ar to form a nitrogen-containing ring structure or both of them may combine with each other to form a nitrogen-containing ring structure.

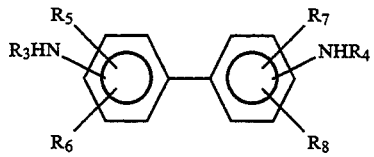

Formula (II)

wherein $R_3$ and $R_4$ may be the same or different and each represent a hydrogen atom, an alkyl group or a phenyl group which may have a substituent; and $R_5$, $R_6$, $R_7$ and $R_8$ may be the same or different and each represent a hydrogen atom, an alkyl group, a hydroxyl group, an alkoxyl group, a mercapto group, an alkylthio group, an amino group, an alkylamino group, a dialkylamino group, a halogen atom, a phenyl group which may have a substituent, or an alkenyl group, $R_5$ and $R_6$ may combine with each other to form a nitrogen-containing ring structure, and $R_7$ and $R_8$ may combine with each other to form a nitrogen containing ring structure.

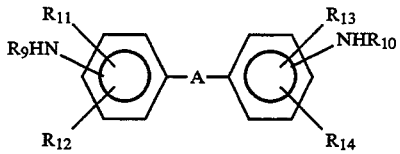

Formula (III)

wherein A represents a linking group; $R_9$ and $R_{10}$ may be the same or different and each represent a hydrogen atom, an alkyl group or a phenyl group which may have a substituent; and $R_{11}$, $R_{12}$, $R_{13}$ and $R_{14}$ may be the same or different and each represent a hydrogen atom, an alkyl group, a hydroxyl group, an alkoxyl group, a mercapto group, an alkylthio group, an amino group, an alkylamino group, a dialkylamino group, a halogen atom, a phenyl group which may have a substituent, or an alkenyl group, $R_{11}$ and $R_{12}$ may combine with each other to form a nitrogen-containing ring structure, and $R_{13}$ and $R_{14}$ may combine with each other to form a nitrogen-containing ring structure.

DESCRIPTION OF PREFERRED EMBODIMENTS

Figure 1:
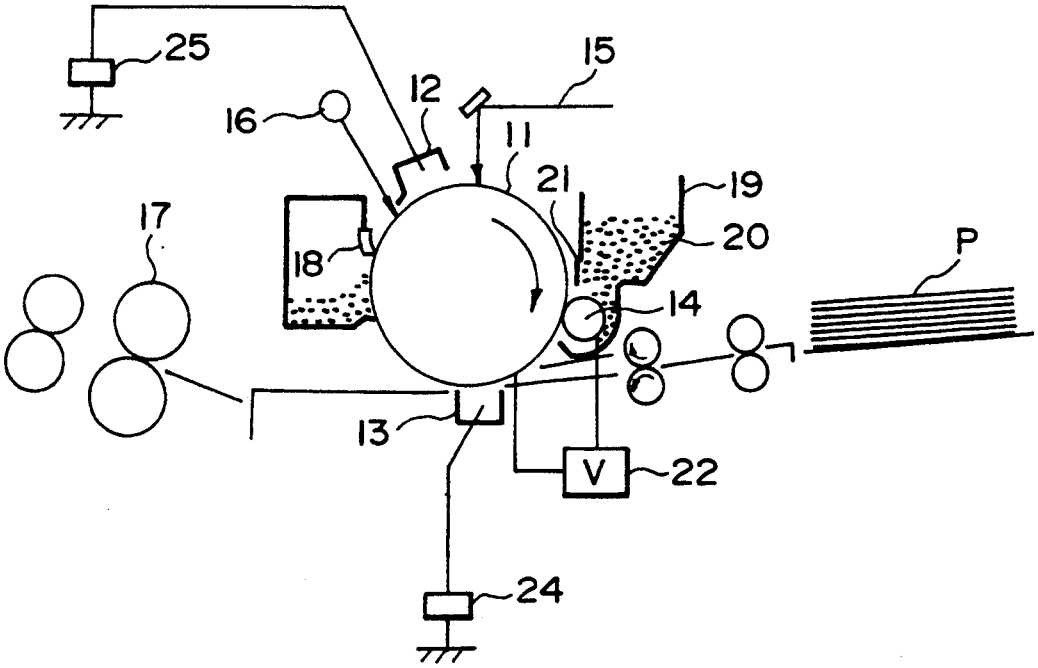
FIG. 1 is a schematic illustration of an example of the image forming apparatus of the present invention.

The binder resin used in the present invention has an acid component as a constituent.

The acid component can be introduced into the resin by the use of a monomer having a carboxyl group or an acid anhydride group. In particular, presence of an acid anhydride is preferred.

The carboxyl group reacts with the amino group of the compound represented by Formula (I), (II) or (III) to form an amide bond, so that polymer chains can be cross-linked. The cross-linking of components having a molecular weight of not less than $10^5$ can impart a rubber elasticity to the toner, so that its anti-offset properties can be improved and also the toner can be prevented from flowing out of a cleaning member of a fixing assembly.

In addition, in the case when an acid anhydride is present in the polymer component, the reaction gives formation of an imide bond. This reaction takes place in a higher reactivity than the formation of an amide, so that the cross-linking can be carried out in a better efficiency.

The acid component must have an acid value of from 0.5 to 100 mg.KOH/g, preferably from 1 to 50 mg.KOH/g. In particular, the acid component may preferably have an acid anhydride. It is also particularly preferred that an acid value ascribable to the acid anhydride is in the range of from 0.5 to 100 mg.KOH/g. If the acid value is less than 0.5 mg.KOH/g, no reaction of the compound having an amino group as used in the present invention may proceed when materials are melted and kneaded in the course of the preparation of toner, tending to make it impossible to well carry out cross-linking, so that in some instances no preferable anti-offset properties can be obtained or the cleaning member of a fixing assembly can not prevent toner from flowing out. If the acid value is more than 50 mg.KOH/g, it becomes difficult from that value to carry out charge control, and if it is more than 100 mg.KOH/g, the chargeability of toners may be damaged or the cross-linking reaction may excessively proceed to adversely affect the fixing performance.

Qualitative and quantitative determination of functional groups in the binder resin used in the present invention can be made by, for example, a method making use of the acid value measurement according to JIS K-0070 and the hydrolysis acid value measurement (measurement of total acid value).

For example, in infrared absorption, an absorption peak assigned to the carbonyl of acid anhydride appears at around 1780 $cm^{-1}$, and thus the presence of the the acid anhydride can be confirmed.

This absorption of the carbonyl of acid anhydride appears on the side of a higher wave number than in the case of ester acids.

The acid value ascribable to acid anhydride can be measured by, for example, a method making use of the acid value measurement prescribed in JIS K-0070 or the hydrolysis acid value measurement (total acid value measurement).

For example, in the acid value measurement according to JIS K-0070 (hereinafter JIS acid value), the acid value ascribable to acid anhydride can be measured by about 50% of the theoretical value (assuming the acid anhydride as a compound having an acid value as that of dicarboxylic acid).

As for the total acid value measurement, the acid value can be measured as substantially that of the theoretical value. Therefore the difference between this total acid value and the JIS acid value is about 50% of the theoretical value and the acid anhydride is measured as a dibasic acid, so that the total acid value ascribable to acid anhydride per gram can be determined. A half (½) of this total acid value is the JIS acid value ascribable to acid anhydride in the JIS acid value. In other words, this corresponds to the difference between the total acid value and the JIS acid value.

An example thereof can be given as follows: In an instance in which monooctyl maleate is used as the acid component, a monooctyl maleate copolymer is synthesized by solution polymerization. By measuring a JIS acid value and a total acid value (A) of the resulting copolymer, a total acid value (B) ascribable to acid anhydride can be determined. This copolymer is further dissolved in monomers to carry out suspension polymerization, where it undergoes ring opening in part. By measuring a JIS acid value and a total acid value (A) of the binder resign thus obtained, a total acid value (B) ascribable to the remaining anhydride can be determined and thus the proportion of the total acid value (B) ascribable to the anhydride, held in the total acid value (A) of the whole binder resin can be determined.

In the present invention, the total acid value is determined in the following way. In 30 ml of dioxane, 2 g of a sample resin is dissolved, to which 10 ml of pyridine, 20 mg of dimethylaminopyridine and 3.5 ml of water are added, followed by heating and reflux for 4 hours with stirring. After cooling, neutralization titration is carried out using a 1/10N KOH-THF solution, and phenolphthalein as an indicator. The acid value thus obtained is regarded as the total acid value.

The 1/10N KOH-THF solution is prepared in the following way. In about 3 ml of water, 1.5 g of KOH is dissolved, to which 200 ml of THF and 30 ml of water are added, followed by stirring. If the resulting solution has been separated after it has been left to stand, a small amount of methanol is added and if the solution is turbid, a small amount of water is added, to give a uniform transparent solution, followed by titration using a 1/10N HCl standard solution.

In the present invention, at least one of the following compounds represented by Formulas (I), (II) and (III) is used as a cross-linking agent.

Formula (I)

$$R_1HN\text{-}Ar\text{-}NHR_2$$

In the formula, Ar represents an aryl group which may have a substituent; and $R_1$ and $R_2$ may be the same or different and each represent a hydrogen atom, an alkyl group or a phenyl group which may have a substituent. The alkyl group represented by $R_1$ and $R_2$ may preferably have 1 to 12 carbon atoms. The substituent of the phenyl group may preferably have 0 to 6 carbon atoms and, in particular, may preferably be an alkyl group or a halogen atom.

At least one of $R_1$ and $R_2$ may combine with Ar to form a nitrogen-containing ring structure or both may combine with each other to form a nitrogen-containing ring structure.

As those represented by $R_1$ and $R_2$, most suitable groups or atoms may be selected depending on the combination of the types of the carboxyl group and acid anhydride in the binder resin and the amounts thereof and also depending on temperature conditions under which cross-linking is carried out. The rate of the reaction of the carboxyl group and acid anhydride may vary depending on the type of its substituent, that is, the electronic effect of the substituent, bulkiness, and also melting point of the compound. As a result, the rate of cross-linking may also vary. According to studies made by the present inventors, the rate of cross-linking is in order of an amino group, an alkylamino group and a phenylamino group.

Ar represents an aryl group which may have a substituent. The aryl group may include a phenyl group, a naphthyl group, a pyridino group, a triazino group, a pyrimidino group, a quinolino group, an acrydino group, a pteridino group, an imidazole group, a pyrazole group, a triazole group and a thiazole group. Taking account of reactivity, thermal stability and storage stability, a phenyl group, a naphthyl group, a pyridino group, a triazino group and an imidazole group are preferred.

The substituent of the aryl group may preferably have 12 or less carbon atoms, and may preferably have 4 or less taking account of readiness in synthesis. The four or less substituents may be independent one another or may combine to form a ring structure.

There are no particular limitations on the type of the substituent. It can be exemplified by a hydrogen atom, an alkyl group having 1 to 6 carbon atoms, a hydroxyl group, an alkoxy group having 1 to 6 carbon atoms, a mercapto group, an alkylthio group having 1 to 6 carbon atoms, an amino group, an alkylamino group having 1 to 6 carbon atoms, a dialkylamino group, a halogen atom, a phenyl group having 6 to 12 carbon atoms, which may have a substituent, and an alkenyl group having 1 to 6 carbon atoms.

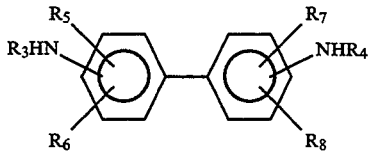

Formula (II)

In the formula, $R_3$ and $R_4$ may be the same or different and each represent a hydrogen atom, an alkyl group or a phenyl group which may have a substituent. The alkyl group represented by $R_3$ and $R_4$ may preferably have 1 to 12 carbon atoms. The substituent of the phenyl group may preferably have 0 to 6 carbon atoms and, in particular, may preferably be an alkyl group or a halogen atom.

As those represented by $R_3$ and $R_4$, most suitable groups or atoms may be selected depending on the combination of the types of the carboxyl group and acid anhydride in the binder resin and the amounts thereof and also depending on temperature conditions under which cross-linking is carried out. The rate of the reaction of the carboxyl group and acid anhydride may vary depending on the type of its substituent, that is, the electronic effect of the substituent, bulkiness, and also melting point of the compound. As a result, the rate of cross-linking may also vary. According to studies made by the present inventors, the rate of cross-linking is in order of an amino group, an alkylamino group and a phenylamino group.

$R_5$, $R_6$, $R_7$ and $R_8$ may be the same or different and each represent a hydrogen atom, an alkyl group, a hydroxyl group, an alkoxy group, a mercapto group, an alkylthio group, an amino group, an alkylamino group, a dialkylamino group, a halogen atom, a phenyl group which may have a substituent, or an alkenyl group.

The alkyl group, the alkoxy group, the alkylthio group and the alkylamino group represented by $R_5$, $R_6$, $R_7$ and $R_8$ may each preferably have 1 to 6 carbon atoms. The alkenyl group may preferably have 2 to 6 carbon atoms. The substituent of the phenyl group may preferably have 0 to 6 carbon atoms. The substituent of this phenyl group may preferably be an alkyl group or a halogen atom. $R_5$ and $R_6$ may combine each other to form a ring structure. $R_7$ and $R_8$ may also combine each other to form a ring structure. Of the substituents described above, $R_5$, $R_6$, $R_7$ and $R_8$ may more preferably be an alkyl group having 1 to 6 carbon atoms and alkylthio group having 1 to 6 carbon atoms taking account of the readiness in synthesis.

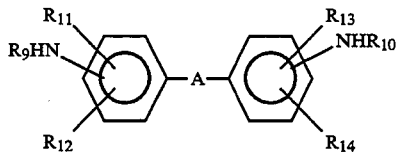

Formula (III)

In the formula, the letter symbol A represents a linking group. There are no particular limitations of the linking group so long as it is a group capable of effecting linkage in synthesis.

However, crosslinks can be formed with difficulty in the case of compounds that can readily take on a resonant structure together with phenyl groups when they have an ionic structure or have a functional group that tends to form an ionic structure. Examples thereof are triphenylmethane dyes and pigments, Rhodamine dyes and pigments, and dyes and pigments having a fluorane structure.

Examples of the linking group are given below. The present invention is not necessarily limited by these.

$-(-CH_2-)_n-$ (n represents an integer of 1 to 6), $-CR_{15}R_{16}-$ ($R_{15}$ and $R_{16}$ each represent a hydrogen atom and an alkyl group having 1 to 6 carbon atoms), —O—, —CO—, —NH—, —CONH—, —NHC(=NH)NH—, —OCNH—, —NHCONH—, —OCO—, —NHCSNH—, —OCONH—, —S—, $-SO_2-$, —SO—, —N=N—, $-SiR_{17}R_{18}OSiR_{17}R_{18}$ ($R_{17}$ and $R_{18}$ each represent an alkyl group having 1 to 8 carbon atoms or a phenyl group),

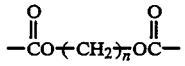

(n represent an integer of 1 to 6),

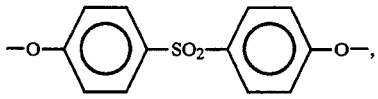

-continued

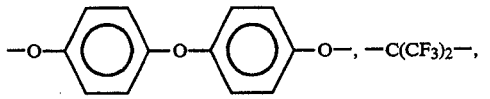

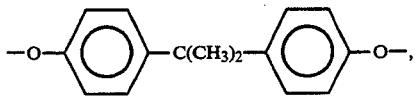

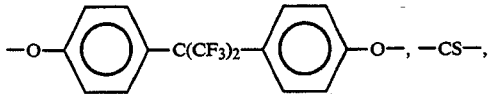

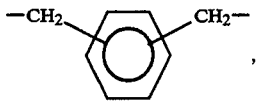

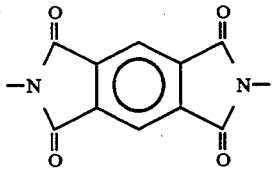

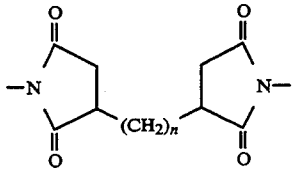

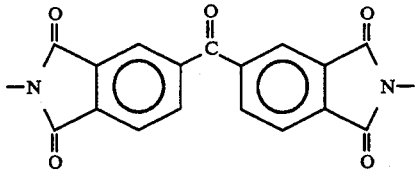

In the formula, $R_9$ and $R_{10}$ may be the same or different and each represent a hydrogen atom, an alkyl group or a phenyl group which may have a substituent. The alkyl group represented by $R_9$ and $R_{10}$ may preferably have 1 to 12 carbon atoms. The substituent of the phenyl group may preferably have 0 to 6 carbon atoms and, in particular, may preferably be an alkyl group or a halogen atom.

As those represented by $R_9$ and $R_{10}$, most suitable groups or atoms may be selected depending on the combination of the types of the carboxyl group and acid anhydride in the binder resin and the amounts thereof and also depending on temperature conditions under which cross-linking is carried out. The rate of the reaction of the carboxyl group and acid anhydride may vary depending on the type of its substituent, that is, the electronic effect of the substituent, bulkiness, and also melting point of the compound. As a result, the rate of cross-linking may also vary. According to studies made by the present inventors, the rate of cross-linking is in order of an amino group, an alkylamino group and a phenylamino group.

$R_{11}$, $R_{12}$, $R_{13}$ and $R_{14}$ may be the same or different and each represent a hydrogen atom, an alkyl group, a hydroxyl group, an alkoxy group, a mercapto group, an alkylthio group, an amino group, an alkylamino group, a dialkylamino group, a halogen atom, a phenyl group which may have a substituent, or an alkenyl group.

The alkyl group, the alkoxy group, the alkylthio group and the alkylamino group represented by $R_{11}$, $R_{12}$, $R_{13}$ and $R_{14}$ may each preferably have 1 to 6 carbon atoms. The alkenyl group may preferably have 2 to 6 carbon atoms. The substituent of the phenyl group may preferably have 0 to 6 carbon atoms. The substituent of this phenyl group may preferably be an alkyl group or a halogen atom. $R_{11}$ and $R_{12}$ may combine with each other to form a ring structure. $R_{13}$ and $R_{14}$ may also combine with each other to form a ring structure. Of the substituents described above, $R_{11}$, $R_{12}$, $R_{13}$ and $R_{14}$ may more preferably be an alkyl group having 1 to 6 carbon atoms and alkylthio group having 1 to 6 carbon atoms taking account of the readiness in synthesis.

Toners containing an amino type cross-linking agent are exemplified by a certain type of alkylenediamine as disclosed in Japanese Patent Application Laid-open No. 58-173752, and a certain type of polyether amine as disclosed in Japanese Patent Application Laid-open No. 58-173756. The present inventors have new studied the alkylenediamine and polyether amine disclosed therein to confirm that toners containing any of these show a more preferable tendency to anti-offset than other conventional toners. They, however, do not have good dispersibility in toners such that fogging may occur depending on conditions for the preparation of toners. Moreover, as copies are taken on a larger number of sheets, such toners tend to contaminate a developer sleeve, and hence may result in a decrease in image density. This tends to occur particularly in high-speed machines. These disadvantages are mainly due to the fact that the compounds proposed in these publications have a low melting point and most of them are waxy.

On the other hand, the amino group-containing compounds represented by Formulas (I), (II) and (III) each have a melting point high enough to be stable also to in-machine temperature rise in a developing assembly or in a cleaning container, and may very little cause melt-adhesion or contamination. Moreover, because of their good dispersibility in the toner, it is possible to obtain fog-free sharp images.

Examples of the compound represented by Formula (I), used as a cross-linking agent in the present invention, are shown below. The present invention is by no means limited by these.

Exemplary Compounds:

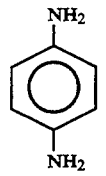

(1)

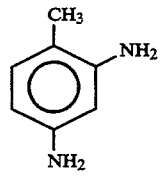

(2)

-continued
(3)
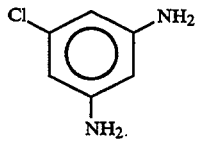
(4)
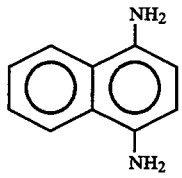
(5)
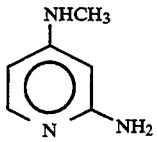
(6)
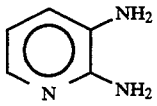
(7)
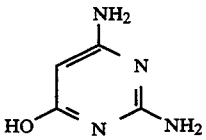
(8)
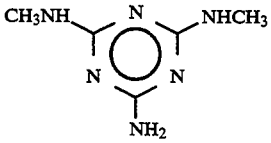
(9)
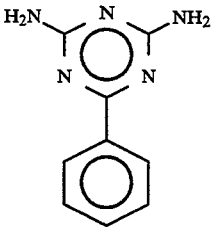
(10)
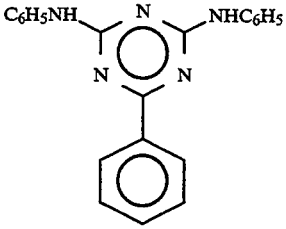
(11)
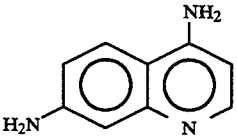
-continued
(12)
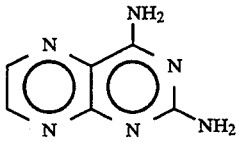
(13)
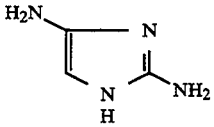
(14)
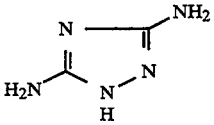
(15)
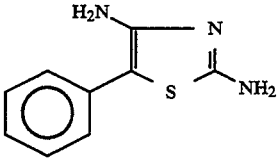
(16)
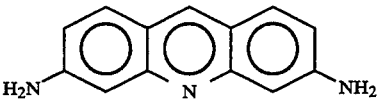
(17)
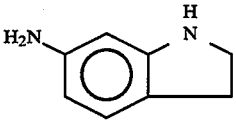
(18)
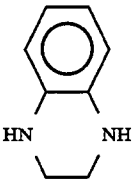
Examples of the compound represented by Formula (II), used as a cross-linking agent in the present invention, are shown below. The present invention is by no means limited by these.
(19)
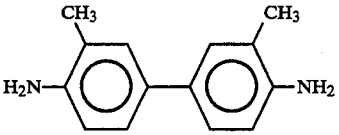
(20)
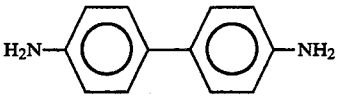
(21)
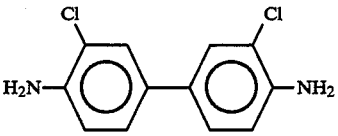

-continued
(22)
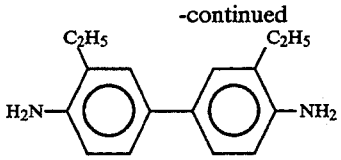
(23)
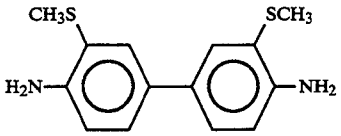
(24)
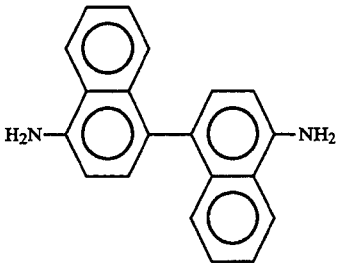
-continued
(25)
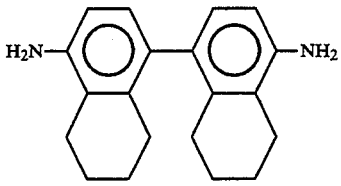
(26)
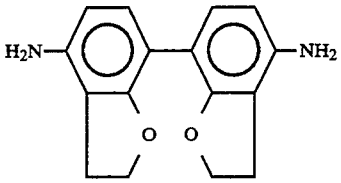
Examples of the compound represented by Formula (III), used as a cross-linking agent in the present invention, are shown below. The present invention is by no means limited by these.
(27)
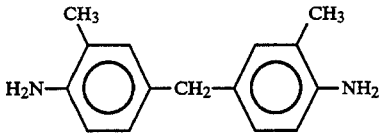
(28)
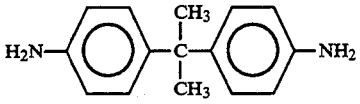
(29)
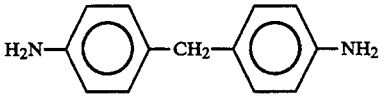
(30)
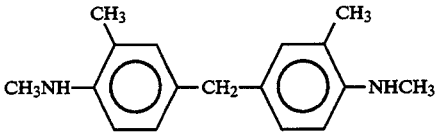
(31)
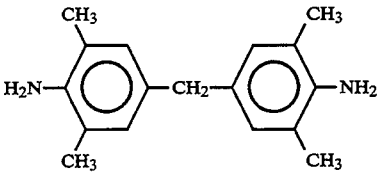
(32)
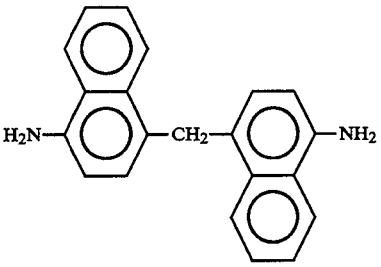

-continued
(33)
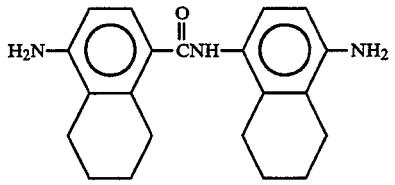
(34)
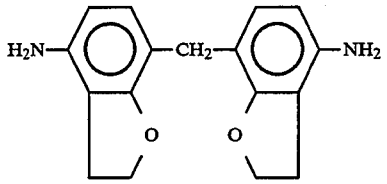
(35)
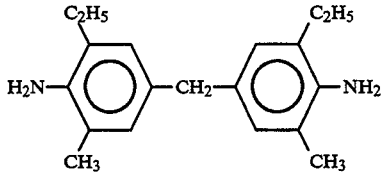
(36)
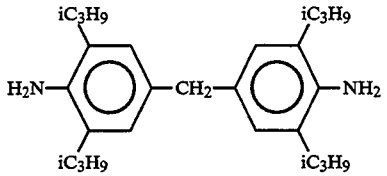
(37)
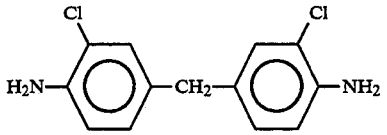
(38)
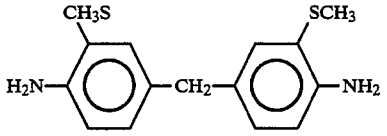
(39)
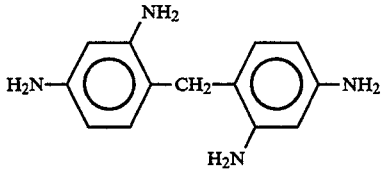
(40)
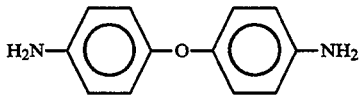
(41)
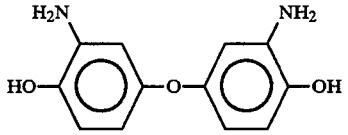
(42)
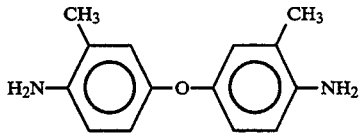

-continued
(43)
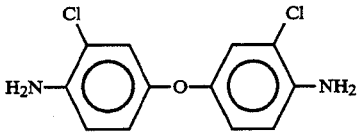
(44)
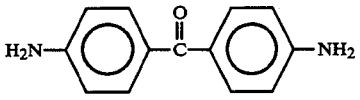
(45)
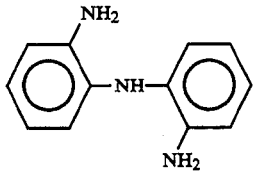
(46)
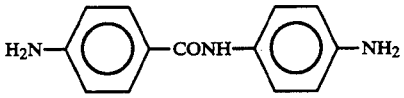
(47)
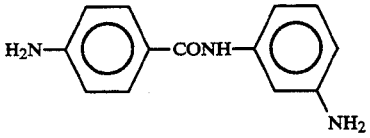
(48)
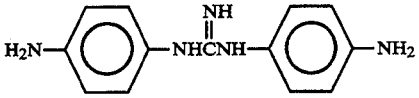
(49)
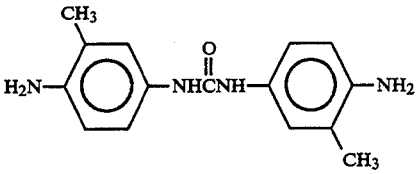
(50)
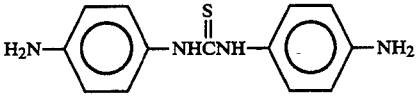
(51)
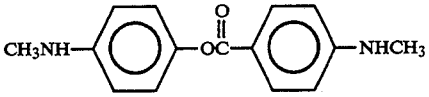
(52)
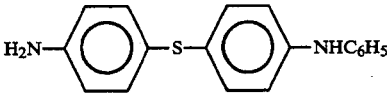
(53)
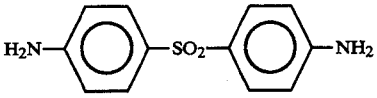
(54)
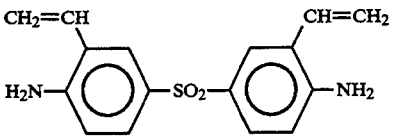

-continued
(55)
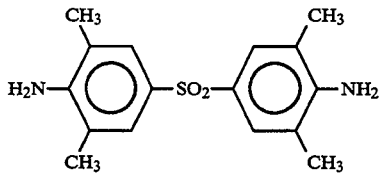
(56)
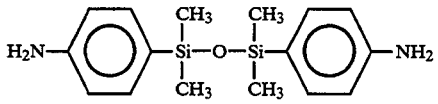
(57)
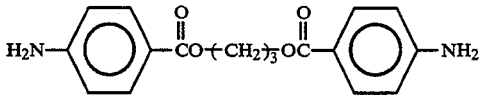
(58)
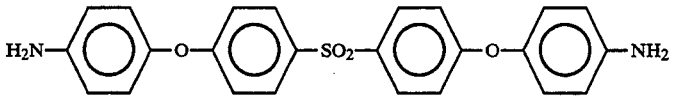
(59)
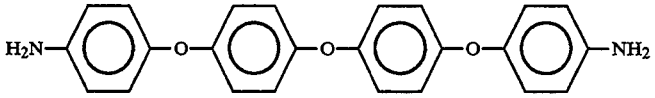
(60)
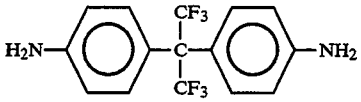
(61)
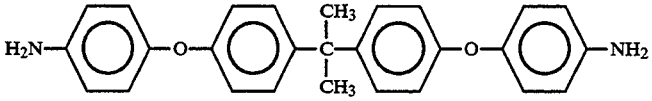
(62)
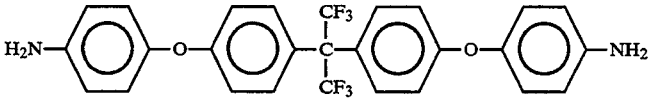
(63)
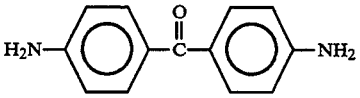
(64)
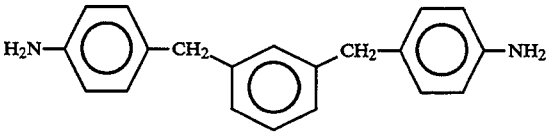
(65)
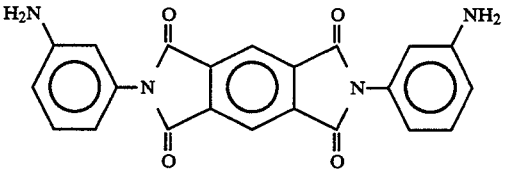
(66)
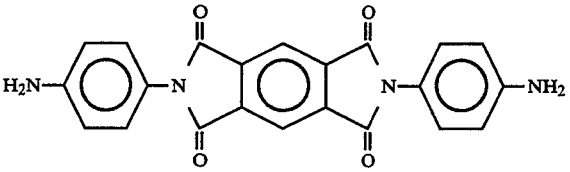

-continued

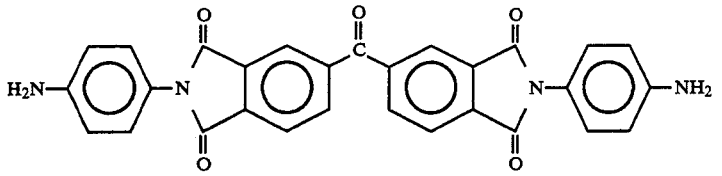

(67)

In the present invention, any of these compounds represented by Formulas (I), (II) and (III) should preferably be used in an amount ranging from 0.01 part by weight to 10 parts by weight, and more preferably from 0.1 part by weight to 5 parts by weight based on 100 parts by weight of a binder resin.

The carboxyl group or acid anhydride group as the acid component of the binder resin according to the present invention reacts with the amino group-containing compound represented by Formula (I), (II) or (III) as shown by exemplary compounds (1) to (67), in part or as a whole during melt-kneading to form an amide bond or imide bond, so that the resin is made to have a cross-linked structure and hence can have superior anti-offset properties.

The amino group-containing compounds represented by Formulas (I), (II) and (III) according to the present invention have a tendency of being positively chargeable. The amide group or imide group formed is also substantially neutral or positively chargeable. Hence, these groups stabilize charge performance in positively chargeable toners and impart a good development performance.

On the resin used in the present invention, there are no particular limitations so long as it has the acid value as defined in the present invention. It is possible to use, for example, homopolymers of styrene or derivatives thereof such as polystyrene, poly-p-chlorostyrene and polyvinyltoluene; styrene copolymers such as a styrene/p-chlorostyrene copolymer, a styrene/vinyltoluene copolymer, a styrene/vinylnaphthalene copolymer, a styrene/acrylate copolymer, a styrene/methacrylate copolymer, a styrene/α-chloromethyl methacrylate copolymer, a styrene/acrylontirle copolymer, a styrene/methyl vinyl ether copolymer, a styrene/ethyl vinyl ether copolymer, a styrene/methyl vinyl ketone copolymer, a styrene/butadiene copolymer, a styrene/isoprene copolymer and a styrene/acrylonitrile/indene copolymer; polyvinyl chloride, phenol resins, natural modified phenol resins, natural resin modified maleic acid resins, acrylic resins, mathacrylic resins, polyvinyl acetate, silicone resins, polyester resins, polyurethanes, polyamide resins, furan resins, epoxy resins, xylene resins, polyvinylbutyral, rosins, modified rosins, tarpane resins, cumarone-indene resins and petroleum resins, which may be in the form of a mixture of two or more kinds, or a block copolymer or grafted product.

Of these, vinyl copolymers or polyester resins are preferred. In particular, vinyl copolymers are preferred.

To obtain vinyl copolymers preferable for the present invention, the following monomers having a carboxyl group or monomers having an acid anhydride group which is a derivative of a carboxyl group can be used as monomers of the vinyl copolymers.

They may include, for example, succinic acid, maleic acid, citraconic acid, dimethylmaleic acid, itaconic acid, alkenylsuccinic acids, and anhydrides of these, unsaturated dibasic acids such as fumaric acid, methaconic acid and dimethylfumaric acid, and monoesters of these unsaturated dibasic acids; acrylic acid, methacrylic acid, crotonic acid, cinnamic acid, and anhydrides of these, anhydrides of the above α,β-unsaturated acids, α,β-unsaturated acids such as anhydrides of lower fatty acids, anhydride monomers of these; alkenylmalonic acids, alkenylglutaric acids, alkenyladipic acids, and anhydrides and monoesters of these.

Of these, monoesters of α,β-unsaturated dibasic acids having a structure such as maleic acid, fumaric acid or succinic acid can be particularly preferably used as monomers for obtaining the binder resin of the present invention.

Such monomers may include, for example, monomethyl maleate, monoethyl maleate, monobutyl maleate, monooctyl maleate, monoallyl maleate, monophenyl maleate, monomethyl fumerate, monoethyl fumerate, monobutyl fumerate, monophenyl fumerate, monobutyl n-butenyl succinate, monomethyl n-octenyl succinate, monoethyl n-butenyl maleate, monomethyl n-dodecenyl glutarete and monobutyl n-butenyl adipate.

Comonomers of the vinyl copolymer may also include the following.

They can be exemplified by styrene, styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene end p-n-dodecylstyrene; ethylene unsaturated monoolefins such as ethylene, propylene, butylene and isobutylene; unsaturated polyenes such as butadiene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-buryl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; acrylic acid or methacrylic acid derivatives such as acrylonitrile, methacrylonitrile and acylamide; and esters of the α,β-unsaturated acids described above, and diesters of dibasic acids. Any of these vinyl monomers may be used alone or in combination of two or more kinds.

Of these, monomers may preferably be used in such a combination that may give a styrene copolymer and a styrene-acrylic copolymer.

The binder resin used in the present invention may optionally be a polymer cross-linked with a cross-linkable monomer (a cross-linking agent) mainly having at least two polymerizable double bonds.

Such a cross-linkable monomer may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether bond, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether bond, as exemplified by polyoxyethylene(2)-2,2-bis(4-hydroxyphenyl)propane diacrylate, polyoxyethylene(4)-2,2-bis(4-hydroxyphenyl)propane diacrylate, and the above compounds whose acrylate moiety has been replaced with methacrylate; and polyester type diacrylate compounds as exemplified by MANDA (trade name; available from Nippon Kayaku Co., Ltd.). A polyfunctional cross-linking agent may include pentaerythritol triacrylate, trimethylolethane triacrylate, trimethylolpropane triacrylate, tetramethylolmethane tetraacrylate, oligoester acrylate, and the above compounds whose acrylate moiety has been replaced with methacrylate; triallylcyanurate, and triallyltrimellitate.

Any of these cross-linkable monomers may be used in an amount of from 0.01 part by weight to 5 parts by weight, and preferably from 0.03 part by weight to 3 parts by weight based on 100 parts by weight of other monomer component.

Of these cross-linkable monomers, those preferably usable in resins for toners in view of fixing performance and anti-offset properties are aromatic divinyl compounds (in particular, divinyl benzene) and diacrylate compounds linked with a chain containing an aromatic group and an ether bond.

The binder resin according to the present invention may be used optionally in the form of its mixture with a homopolymer of any of the vinyl monomers previously described, a copolymer thereof, polyester, polyurethane, epoxy resin, polyvinyl butyral, rosin, modified rosin, terpene resin, phenol resin, aliphatic or alicyclic hydrocarbon resin, aromatic petroleum resin, haloparaffin or paraffin wax.

In the present invention, it is also preferred to use a polyester resin. When the polyester resin is used, the polyester resin has the composition as shown below.

As a dihydric alcohol component, it may include diols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (IV).

Formula (IV)

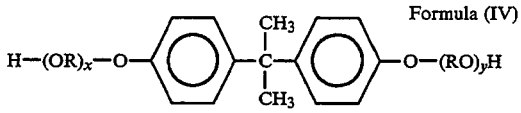

wherein R represents an ethylene group or a propylene group, x and y are each an integer of 0 or more, and an average value of x+y is 0 to 10;

and a diol represented by the following Formula (V).

Formula (V)

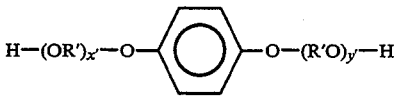

wherein R′ represents $-CH_2CH_2-$,

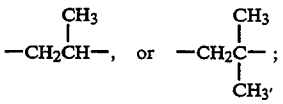

x′ and y′ are each an integer of 0 or more, and an average value of x′+y′ is 0 to 10.

As a dibasic acid, it may include benzene dicarboxylic acids or anhydrides thereof such as phthalic acid, terephthalic acid, isophthalic acid and phthalic anhydride; alkyldicarboxylic acids such as succinic acid, adipic acid, sebacic acid and azelaic acid, or anhydrides thereof; alkenylsuccinic acids or alkylsuccinic acids such as n-dodecenylsuccinic acid and n-dodecylsuccinic acid and anhydrides of these acids; unsaturated dicarboxylic acids such as a lower alkyl ester, fumetic acid, maleic acid, citraconic acid and iraconic acid, or anhydrides thereof; and dicarboxylic acids such as a lower alkyl ester, and derivatives thereof.

A trihydric or higher alcohol component and a tribasic or higher acid component serving also as cross-linking components may also be used in combination.

The trihydric or higher, polyhydric alcohol component may include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

The tribasic or higher, polycarboxylic acid component may include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, and anhydrides or lower alkyl esters of these; and polybasic carboxylic acids and derivatives thereof such as a tetracarboxylic acid represented by the formula:

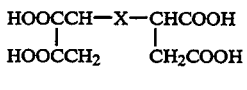

wherein X represents an alkylene group or alkenylene group having 5 to 30 carbon atoms having at least one side chain having 3 or more carbon atoms, and anhydrides or lower alkyl esters thereof.

The alcohol component should be in an amount of from 35 to 65 mol %, and preferably from 40 to 60 mol %; and the acid component, from 65 to 35 mol %, and preferably from 60 to 40 mol %.

The trihydric or -basic or higher, polyhydric or -basic component should be in an amount of from 5 to 60 mol % of the whole components.

Preferred alcohol components of the polyester resin are bisphenol derivatives represented by Formula (IV) described above. Preferred acid components are phthalic acid, terephthalic acid, isophthalic acid or anhydrides thereof; succinic acid, n-dodecenylsuccinic acid or anhydrides thereof; dicarboxylic acids such as fumaric acid, maleic acid, and maleic anhydride; and tricarboxylic acids such as trimellitic acid or an anhydride thereof.

The polyester resin obtained from any of these acids or alcohols shows sharp melting properties, has a good fixing performance as required of toners for heat-roller fixing, and has superior anti-offset properties.

The polyester resin obtained here should have a glass transition temperature of from 50° to 70° C., and preferably from 55° to 65° C., and also have a number average molecular weight (Mn) of from 1,500 to 10,000, and preferably from 2,000 to 7,000 and a weight average molecular weight (Mw) of from 6,000 to 200,000, and preferably from 10,000 to 150,000.

In the synthesis of the binder resin used in the present invention, a conventional polymerization initiator may be used which is used in bulk polymerization, solution polymerization, suspension polymerization and emulsion polymerization.

The polymerization initiator may include, for example, t-butylperoxy-2-ethylhexanoate, cumine perpivalate, t-butylperoxylaurate, benzoyl peroxide, lauroyl peroxide, octanoyl peroxide, di-t-butyl peroxide, t-butylcumylperoxide, dicumyl peroxide, 2,2'-azobis(2-isobutyronitrile), 2,2'-azobis(2-methylbutyronitrile), 2,2'-azobis(2,4-dimethylvaleronitrile), 2,2'-azobis(4-methoxy-2,4-dimethylvaleronitrile), 1,1-bis(t-butylperoxy)-3,3,5-trimethylcyclohexane, 1,1-bis(t-butylperoxy)cyclohexane, 1,4-bis(t-butylperoxycarbonyl)cyclohexane, 2,2-bis(t-butylperoxy)octane, n-butyl-4,4-bis(t-butylperoxy) valylate, 2,2-bis(t-butylperoxy)butane, 1,3-bis(t-butylperoxy-isopropyl)benzene, 2,5-dimethyl-2,5-di(t-butylperoxy)hexane, 2,5-dimethyl-2,5-di(t-butylperoxy) hexane, 2,5-dimethyl-2,5-di(benzoylperoxy)hexane, di-t-butylperoxyisophthalate, 2,2-bis(4,4-di-t-butylperoxycyclohexyl)propane, di-t-butylperoxy-α-methylsuccinate, di-t-butylperoxydimethylglutarate, di-t-butylperoxyhexahydroterephthalate, di-t-butylperoxyazelate, 2,5-dimethyl-2,5-di(t-butylperoxy)hexane, diethylene glycol-bis(t-butylperoxycarbonate), di-t-butylperoxytrimethyladipate, tris(t-butylperoxy) triazine, and vinyl tris(t-butylperoxy)silane. Any of these may be used alone or in combination.

The initiator may preferably be used in an amount of not less than 0.05 part by weight, and more preferably from 0.1 part by weight to 15 parts by weight based on 100 parts by weight of the monomers.

The binder resin according to the present invention can be synthesized using a method such as bulk polymerization, solution polymerization, suspension polymerization or emulsion polymerization. In the case when carboxylic acid monomers and anhydride monomers are used, it is preferred to use bulk polymerization or solution polymerization in view of the properties of the monomers.

In the present invention, the vinyl polymer can be obtained by, for example, a method as described in the following: The vinyl copolymer can be obtained by bulk polymerization or solution polymerization, using monomers such as dicarboxylic acids, dicarboxylic acids anhydrides and dicarboxylic acid monoesters. In the solution polymerization, dicarboxylic acid or dicarboxylic acid monoester units can be partly made into anhydrides by devising conditions for evaporation when the solvent is evaporated. The vinyl copolymer obtained by bulk polymerization or solution polymerization may also be heated to further make the units into anhydrides. The anhydrides may also be partly esterified using an alcohol.

Inversely, the vinyl copolymer thus obtained may be hydrolyzed to make anhydrides undergo ring opening to partly make them into dicarboxylic acids.

Alternatively, the vinyl copolymer obtained by bulk polymerization or emulsion polymerization using dibarboxylic acid monoester monomers may be heated to form anhydrides, or may be hydrolyzed to make anhydrides undergo ring opening to make them into dicarboxylic acids. The vinyl copolymer obtained by bulk polymerization or solution polymerization may be dissolved in monomers and then may be subjected to suspension polymerization or emulsion polymerization to give a vinyl polymer. Use of this method enables partial ring opening of anhydrides to give dicarboxylic acids. At this time, a different type of resin may be mixed in monomers, and the resin obtained may be heated to form anhydrides, may be treated with a weak alkali to effect ring opening or may be treated with an alcohol to effect esterification.

The dicarboxylic acid and dicarboxylic acid anhydride are strongly alternatingly copolymerizable and hence it is preferred to use the following method in order to obtain a vinyl copolymer in which functional groups such as anhydrides and dicarboxylic acids are dispersed at random. It is a method in which dicarboxylic acid monoesters monomers are subjected to solution polymerization to produce a vinyl copolymer, and the resulting vinyl copolymer is dissolved in monomers, followed by suspension polymerization to give a binder resin. In this method, dicarboxylic acid monoester units can be brought into ring closure by removal of alcohol and made into anhydrides according to conditions of treatment when the solvent is removed, so that acid anhydrides can be obtained. At the time of suspension polymerization, acid anhydrides further undergo ring opening by hydrolysis, so that dicarboxylic acids are obtained.

For the anhydrides in the polymer, infrared absorption of carbonyl shifts to the side of a higher wavelength than in the case of acids or esters, and thus their formation or disappearance can be confirmed.

The binder resin thus obtained is a binder resin in which carboxyl groups, anhydride groups and dicarboxylic acid groups are dispersed at random and in a uniform state, and hence it can give a uniform cross-linked structure in the toner.

The toner for developing electrostatic images according to the present invention may preferably comprise a binder resin having at least a peak in the region of a molecular weight of from $5\times10^3$ to $5\times10^4$ and a peak or shoulder in the region of a molecular weight of not less than $10^5$, in the molecular weight distribution measured by GPC (gel permeation chromatography) of resin components in toner particles, and containing a resin component with the molecular weight of not less than $10^5$ in an amount of from 5% by weight to 50% by weight in the binder resin. Such a toner is particularly preferable when used in high-speed machines.

In the present invention, good fixing performance, anti-offset properties and grindability can be achieved when the binder resin has at least a peak in the region of a molecular weight of from $5\times10^3$ to $5\times10^4$ in the molecular weight distribution measured by GPC of resin components in toner particles.

A component with a molecular weight of less than $5\times10^3$ is presumed to tend to bring about molecular weight dependence of the Tg (glass transition point) of toner to be measured, after a long time and tend to result in a little lower Tg of toner to be measured, after a long time. Hence, if this component with a molecular weight of less than $5\times10^3$ becomes so large in quantity in the resin components of toner particles that the peak of molecular weight measured by GPC is present in the region of a molecular weight of less than $5\times10^3$, the toner usually comes to exhibit thermal behavior at a temperature not higher than the Tg to be measured, so that it becomes impossible to satisfy the performance expected from the Tg of toner. For example, in a high-speed system, the frictional heat produced at the part of a cleaner of a photosensitive member is so large that the toner tends to melt-adhere to the photosensitive member or the photosensitive member tends to cause filming due to the toner. It is also possible that, when toner is continuously produced over a long period of time, the toner melt-adhere to the inside of a grinding machine.

Moreover, because of a poop blocking resistance when pressure is applied to toner (e.g., a state in which toner is left to stand under its own weight in a large toner container with a capacity of 1 kg or more), the toner tends to cause agglomeration in the toner container during storage or transportation of the toner.

The component with a molecular weight of less than $5\times10^3$ is a component that particularly contributes an improvement in the grindability of toner particles. If this component with a molecular weight of less than $5\times10^3$ becomes so large in quantity in the resin components of toner particles that the peak of molecular weight measured by GPC is present in the region of a molecular weight of less than $5\times10^3$ an excessive pulverizerion of toner particles may occur to give an increase in ultrafine powder formed, resulting in a decrease in productivity such as a poor classification efficiency. If such ultrafine powder not completely classified is contained in the toner in a large quantity, the content of ultrafine powder gradually increases with repetition of toner feeding and the ultrafine powder may adhere to a toner triboelectricity-providing member (a toner carrying member) because of an electrostatic force, so that the ultrafine powder may hinder the toner from being triboelectrically charged to cause a poor development performance such as a decrease in image density or occurrence of fogging. The component with a molecular weight of less than $5\times10^3$ is also a component that decreases partial viscosity of the toner and hence supplementarily contributes an improvement in fixing performance. If this component with a molecular weight of less than $5\times10^3$ becomes so large in quantity in the resin components of toner particles that the peak of molecular weight measured by GPC is present in the region of a molecular weight of less than $5\times10^3$, the toner can not be completely prevented from flowing out of a cleaning member of a fixing assembly described later, the toner may adhere to the triboelectricity-providing member (a toner carrying member) to soil a developer sleeve, or the carrier-spent may occur, so that the triboelectricity-providing ability may be lowered, resulting in a poor development performance.

The component with a molecular weight of not more than $5\times10^4$ is a component that contributes an improvement in fixing performance and grindability. In the resin components of toner particles, this component may preferably be in an amount of 30% to 95%, and more preferably from 40% to 90%, in the molecular weight distribution. If this component is in an amount less than 30%, it is difficult to achieve a satisfactory fixing performance and the grindability tends to be poor. If this component is in an amount more than 95%, it becomes difficult to achieve satisfactory anti-offset properties.

In the toner for developing electrostatic images according to the present invention, good anti-offset properties can be achieved when the binder resin has a peak or shoulder in the region of a molecular weight of not less than $10^5$ in the molecular weight distribution measured by GPC of resin components in toner particles. This is thus preferable.

The shoulder referred to in the present invention is a point at which a differential value on the GPC chromatogram curve reaches an extreme value, i.e., a turning point.

The component with a molecular weight of not less than $10^5$ is a component that contributes an improvement in anti-offset properties, and may preferably be in an amount of from 5% by weight to 50% by weight, and more preferably from 10% by weight to 50% by weight, in the binder resin, in the molecular weight distribution measured by GPC of resin components in toner particles. If this component is in an amount less than 5%, it tends to become difficult to achieve good anti-offset properties, and also the toner tends not to be completely prevented from flowing out of a cleaning member of a fixing assembly described later.

Hence, the toner for developing electrostatic images according to the present invention may preferably comprise a binder resin having at least a peak in the region of a molecular weight of from $5\times10^3$ to $5\times10^4$ and a peak or shoulder in the region of a molecular weight of not less than $10^5$, in the molecular weight distribution measured by GPC of resin components in toner particles.

In the present invention, the molecular weight distribution of the chromatogram obtained by GPC (gel permeation chromatography) using THF as a solvent is measured under the following conditions.

Columns are stabilized in a heat chamber of 40° C. To the columns kept at this temperature, THF (tetrahydrofuran) as a solvent is flowed at a flow rate of 1 ml per minute, and about 100 μl of THF sample solution is injected thereinto to make measurement. In measuring the molecular weight of the sample, the molecular weight distribution ascribed to the sample is calculated from the relationship between the logarithmic value and count number of a calibration curve prepared using several kinds of monodisperse polystyrene standard samples. As the standard polystyrene samples used for the preparation of the calibration curve, it is suitable to use samples with molecular weights of from $10^2$ to $10^7$, which are available from Showa Denko KK. or Toso Co., Ltd., and to use at least about 10 standard polystyrene samples. An RI (refractive index) detector is used as a detector. Columns should be used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G1000H($X_{XL}$), G2000H($X_{XL}$), G3000H($X_{XL}$), G4000H($X_{XL}$), G5000H($X_{XL}$), G6000H($X_{XL}$), G7000H($X_{XL}$) and TSK guard column, available from Tosoh Co., Ltd.

The sample is prepared in the following way: A sample is put in THF, and is left to stand for several hours, followed by thorough shaking so as to be well mixed with the THF (until coalescent matters of the sample has disappeared), which is further left to stand for at least 12 hours. At this time, the sample is so left as to stand in THF for at least 24 hours in total. Thereafter, the solution having been passed through a sample-treating filter (pore size: 0.45 to 0.5 μm; for example, MAISHORI DISC H-25-5 available from Tosoh Corporation or EKICRO DISC 25CR, available from Gelman Sciences Japan, Ltd., can be utilized) is used used as the sample for GPC. The sample is so prepared to have resin components in a concentration of from 0.5 to 5 mg/ml.

The resin components of the toner particles according to the present invention, having the specific molecular weights, can be obtained using, for example, the method as described below. Polymer (L) having a main peak in the region of a molecular weight of from $5\times10^3$ to $5\times10^4$ in the molecular weight distribution measured by GPC and polymer (H) having a main peak in the region of a molecular weight of not less than $10^5$ are each prepared using solution polymerization, bulk polymerization, suspension polymerization, emulsion polymerization, block polymerization or grafting, and then these components are blended during melt kneading.

Particularly preferred methods may include a method in which one of polymer (L) and polymer (H) is prepared by solution polymerization and is blended with the other when polymerization is completed, a method in which one of the polymers is polymerized in the presence of the other polymer, a method in which polymer (H) is formed by suspension polymerization and polymer (L) is prepared by solution polymerization in the presence of the polymer (H), a method in which polymer (H) is blended in a solvent when solution polymerization for polymer (L) is completed, and a method in which polymer (H) is prepared by suspension polymerization in the presence of polymer (L). Use of any of these methods can give a polymer comprised of a low-molecular weight component and a high-molecular weight component which are uniformly mixed.

In the bulk polymerization, a low-molecular weight polymer can be produced by carrying out the polymerization at a high temperature and accelerating termination reaction. There, however, a problem of a difficulty in reaction control. In the solution polymerization, a low-molecular weight polymer can be readily obtained under mild conditions by utilizing a difference in chain transfer of radicals, ascribable to its solvent, or controlling the amount of its initiator and reaction temperatures. Thus the latter is preferred when the low-molecular weight component is formed in the resin composition used in the present invention.

In the solution polymerization, a solvent such as xylene, toluene, cumene, acetic acid cellosolve, isopropyl alcohol or benzene is used. Such a solvent may be appropriately selected depending on the polymer to be formed by polymerization. In the case of a mixture of styrene monomers, xylene, toluene or cumene is preferred.

Reaction temperature may vary depending on the solvent to be used, the initiator and the polymer to be formed by polymerization. The reaction may preferably be carried out at 70° C. to 230° C.

The solution polymerization may preferably be carried out using the monomers in an amount of from 30 to 400 parts by weight based on 100 parts by weight of the solvent. Other polymer(s) may also preferably be mixed in the solution when polymerization is completed, where several kinds of polymers can be well mixed.

As methods for obtaining the high-molecular weight component, emulsion polymerization and suspension polymerization are preferred.

Of these, the emulsion polymerization is a method in which monomers almost insoluble in water are dispersed in an aqueous phase in the form of small particles by the use of an emulsifying agent and then polymerized using a water-soluble polymerization initiator. In this method, the heat of reaction can be readily controlled and the phase where polymerization takes place (an oily phase comprised of polymers and monomers) and the aqueous phase are separated, so that the rate of termination reaction can be low and hence the rate of polymerization can be high, making it possible to obtain a product with a high degree of polymerization. In addition, because of a relative simple polymerization process and also because of a polymerization product formed of fine particles, the product can be readily mixed with colorants, charge control agents and other additives in the manufacture of the toner, and hence this method is more advantageous than other methods, as a method of producing binder resins for toner.

The emulsion polymerization, however, tends to give an impurity to the resulting polymer because of an emulsifying agent added, and also requires operations such as salting-out to take out the polymer. Thus it is more preferred to use the suspension polymerization that does not require such operations.

The suspension polymerization should be carried out using monomers in an amount of not more than 100 parts by weight, and preferably from 10 to 90 parts by weight, based on 100 parts by weight of a water-based solvent. Usable dispersants may include polyvinyl alcohol, polyvinyl alcohol partially saponified product, and calcium phosphate. Any of these dispersants should be used in a suitable amount in relation to the quantity of monomers, and usually used in an mount of from 0.05 to 1 part by weight based on 100 parts by weight of the water-based solvent. The polymerization can be suitably carried out at a temperature of from 50° to 95° C., which should be appropriately selected according to an initiator to be used and the intended polymer. As the types of the initiator, those insoluble or slightly soluble in water can be used. In particular, in order to obtain the high-molecular weight component, it is preferred to use a bifunctional or higher, polyfunctional initiator.

The toner for developing electrostatic images according to the present invention may optionally contain a charge control agent so that its chargeability can be made more stable.

Charge control agents usable in the toner for developing electrostatic images may include the following charge control agents, which are known in the present technical field.

Those capable of controlling the toner to be negatively chargeable can be exemplified by organic metal compounds or chelate compounds as effective agents, including monoazo metal complexes, acetylacetone metal complexes, metal complexes of aromatic hydroxycarboxylic acids, and metal complexes of aromatic dicarboxylic acids, and additionally including aromatic hydroxycarboxylic acids, aromatic monocarboxylic acids, aromatic polycarboxylic acids, and metal salts, anhydrides or esters of these, and phenol derivatives such as bisphenol.

Those capable of controlling the toner to be positively chargeable can be exemplified by Nigrosine and modified products thereof, modified with a fatty acid metal salt; quaternary ammonium salts such as tributylbenzylammonium 1-hydroxy-4-naphthosulfonate, tetrabutylammonium tetrafluoroborate, and analogues of these, onium salts such as phosphonium salts, and lake pigments of these; triphenylmethane dyes and lake pigments of these (a lake forming agent may include tungstophosphoric acid, molybdophosphoric acid, tungstomolybdophosphoric acid, tannic acid, lauric acid, gallic acid, ferricyanides and ferrocyanides; metal salts of higher fatty acid; acetylacetone metal complexes; diorganotin oxides such as dibutyltin oxide, dioctyltin oxide and dicyclohexyltin oxide; and diorganotin borates such as dibutyltin borate, dioctyltin borate and dicyclohexyltin borate. Any of these may be used alone or in combination of two or more kinds. Of these, Nigrosine type or quaternary ammonium type charge control agents may particularly preferably be used.

In the toner for developing electrostatic images according to the present invention, it is preferred to add fine silica powder for the purpose of improving charge stability, developability, fluidity and durability.

The fine silica powder used in the present invention may have a specific surface area, as measured by the BET method using nitrogen absorption, of not less than 30 $m^2/g$, and preferably from 50 to 400 $m^2/g$, within the range of which good results can be obtained. The fine silica powder should preferably be used in an amount of from 0.01 part by weight to 8 parts by weight, and more preferably from 0.1 part by weight to 5 parts by weight, based on 100 parts by weight of the toner.

For the purpose of making the powder hydrophobic and controlling chargeability, the fine silica powder that may be used in the present invention may also preferably have been optionally treated with a treating agent such as silicone varnish, every sort of silicone varnish, silicone oil, every sort of silicone oil, a silane coupling agent, a functional group-containing silane coupling agent, and other organic silicon compound, or with any of these treating agents used in combination.

To the toner for developing electrostatic images according to the present invention, other additives may be further added for various purposes.

Such other additives may include lubricants such as Teflon, zinc stearate and polyvinylidene fluoride (in particular, polyvinylidene fluoride is preferred); abrasives such as cerium oxide, silicon carbide and strontium titanate (in particular, strontium titanate is preferred); fluidity-providing agents such as colloidal silica and aluminum oxide (in particular, hydrophobic colloidal silica is preferred); anti-caking agents; conductivity-providing agents such as carbon black, zinc oxide, antimony oxide and tin oxide; and developability improvers such as white fine particles and black fine particles having the polarity opposite to the charge polarity of the toner.

For the purpose of improving releasability at the time of heat-roll fixing, it is preferred to add to toner particles a waxy substance such as a low-molecular weight polyethylene, a low-molecular weight polypropylene, microcrystalline wax, carnauba wax, sazol wax or paraffin wax, in an amount of from 0.5 part by weight to 10 parts by weight based on 100 parts by weight of the binder resin.

The toner for developing electrostatic images according to the present invention may also be used in the form of a mixture of toner particles and carrier particles, when used as a two-component developer. In this instance, the toner particles and the carrier particles may be mixed in such a ratio that toner particles are in an amount of from 0.1 to 50% by weight, preferably from 0.5 to 10% by weight, and more preferably from 3 to 5% by weight.

As the carrier particles usable when the toner for developing electrostatic images according to the present invention is used as a two-component developer, it is possible to use all sorts of known materials. They include, for example, powders having magnetic properties, such as iron powder and ferrite powder, nickel powder, glass beads, and glass beads whose surfaces have been coat-treated with a resin such as a fluorine resin, a vinyl resin or a silicone resin.

The toner for developing electrostatic images according to the present invention may further contain a magnetic material so that it can be used as a magnetic toner. In this instance the magnetic material may serve as a colorant at the same time. The magnetic material contained in such a magnetic toner may include iron oxides such as magnetite, hematite and ferrite; metals such as iron, cobalt and nickel, or alloys of any of these metals with any of metals such as aluminum, cobalt, copper, lead, magnesium, tin, zinc, antimony, beryllium, bismuth, cadmium, calcium, manganese, selenium, titanium, tungsten and vanadium, and mixtures of any of these.

These magnetic materials may be those having an average particle diameter of 2 $\mu m$ or less, preferably from 0.1 $\mu m$ to 2 $\mu m$, and more preferably from 0.1 $\mu m$ to 0.5 $\mu m$, in approximation. The magnetic material may be contained in the magnetic toner in an amount of from about 20 to 200 parts by weight based on 100 parts by weight of the resin components, and particularly preferably from 40 to 150 parts by weight based on 100 parts by weight of the resin components.

These magnetic materials may also preferably be those having a coercive force of from 20 to 300 Oe, and more preferably from 50 to 150 Oe, a saturation magnetization of from 50 to 200 emu/g, and a residual magnetization of from 2 to 20 emu/g, as magnetic properties under application of 10 kOe.

The colorant usable in the toner for developing electrostatic images according to the present invention may include any suitable pigment or dye. The colorants for the toner are well known materials. For example, the pigment may include carbon black, Aniline Black, acetylene black, Naphtol Yellow, Hanza Yellow, Rhodamine Lake, Alizarin Lake, red iron oxide, Phthalocyanine Blue and Indanthrene Blue. The pigment is used in such an amount that is necessary and sufficient for maintaining the optical density of fixed images, and should preferably be added in an amount of from 0.1 part by weight to 20 parts by weight, and more preferably from 2 to 10 parts by weight, based on 100 parts by weight of the resin components in toner particles. The dye may also be used for the same purpose. For example, the dye may include azo dyes, anthraquinone dyes, xanthene dyes and methine dyes. The dye should preferably be added in an amount of from 0.1 part by weight to 20 parts by weight, and more preferably from 0.3 part by weight to 10 parts by weight, based on 100 parts by weight of the resin components in toner particles.

The toner for developing electrostatic images according to the present invention may be prepared by a method comprising thoroughly mixing the vinyl resin, the metal salt or metal complex and the pigment or dye as the colorant and the magnetic material, optionally together with the the charge control agent and other additives by means of a mixing machine such as a Henschel mixer or a ball mill, thereafter melt-kneading the mixture by the use of a heat kneading machine such as a heating roll, a kneader or an extruder so that resins are mutually compatibilized and the metal compound, pigment or dye and magnetic material are dispersed or dissolved therein, and cooling the resulting product to effect solidification, followed by pulverization and classification to give the toner according to the present invention.

The toner particles may be used as they are, as the toner for developing electrostatic images according to the present invention. Any desired additives may be optionally further added to the toner particles, followed by thorough mixing using a mixing machine such as a Henschel mixer to give the toner for developing electrostatic images according to the present invention.

Figure 2:
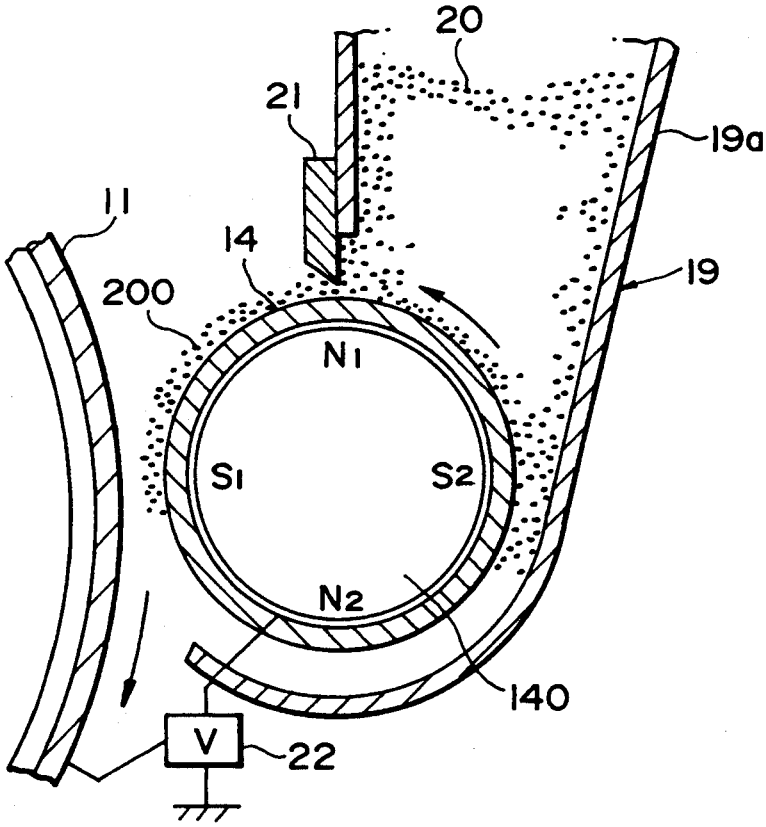
FIG. 2 is a partial enlarged view of FIG. 1, to illustrate a developing step.

The image forming apparatus of the present invention will be described below with reference to FIGS. 1 and 2.

Reference numeral 12 denotes a charging assembly which is a charging means for electrostatically charging an OPC photosensitive drum 11 serving as an electrostatic image bearing member. Reference numeral 25 denotes a powder source which applies a voltage to the charging assembly 12, and supplies a given voltage to the charging assembly 12. Reference numeral 13 denotes a transfer charging assembly serving as a transfer means. A given bias voltage is applied to the transfer charging assembly from a constant-voltage power source 24. As conditions for the bias, it is preferred for a current value to be from 0.1 to 50 μA and for a voltage value (absolute value) to be from 500 to 4,000 V.

The surface of the photosensitive drum is, for example, negatively charged by the operation of the charging assembly 12 serving as the charging means, having a powder source (voltage applying means) 25, and the charged surface is exposed to light by optical image exposure as a latent image forming means 15 to form an electrostatic latent image. The latent image thus formed is developed using a positively chargeable toner 20 held in a developing assembly 19 serving as a developing means, equipped with a magnetic blade 21 made of iron, serving as a toner layer thickness controlling member, and a non-magnetic developing sleeve 14 in which a magnet 140 is provided, serving as a toner carrying member. The developing sleeve 14 is comprised of a stainless steel sleeve (SUS304) having a diameter of 50 mm and a plurality of spherical traced concavities. In the developing zone, an AC bias, a pulse bias and/or a DC bias is/are applied across a conductive substrate of the photosensitive drum 11 and the developing sleeve 14 through a bias applying means 22. A recording medium P is fed and delivered to a transfer zone, where the recording medium P is electrostatically charged from its back surface (the surface opposite to the photosensitive drum) through a transfer charging assembly 13, so that the developed image (toner image) on the surface of the photosensitive drum 11 is electrostatically transferred to the recording medium P. The recording medium P separated from the photosensitive drum 11 is subjected to fixing using a heat-pressure roller fixing unit 17 so that the toner image on the recording medium P can be fixed.

The positively chargeable toner 20 remaining on the photosensitive drum 11 after the transfer step is removed by the operation of a cleaning assembly 18 having a cleaning blade. After the cleaning, the residual charges on the surface of the photosensitive drum 11 is eliminated by erase exposure 16, and thus the procedure again starting from the charging step using the charging assembly 12 is repeated.

The photosensitive drum 11 comprises an OPC photosensitive layer and a conductive substrate, and is rotated in the direction of an arrow. In the developing zone, the developing sleeve 14, a non-magnetic cylinder, which is the toner carrying member, is rotated so as to move in the same direction as the direction in which the photosensitive drum 11 is rotated. Inside the developing sleeve 14, a multi-polar permanent magnet 140 (magnet roll) serving as a magnetic field generating means is provided in an unrotatable state. The multi-polar permanent magnet 140 is preferably set to have magnetic poles consisting of $N_1$: 500 to 900 gausses, $N_2$: 600 to 1,100 gausses, S1: 800 to 1,500 gausses and S2: 400 to 800 gausses. The positively chargeable toner 20 held in the developing assembly 19 is coated on the surface of the developing sleeve 14, and plus triboelectric charges are imparted to the positively chargeable toner because of the friction between the surface of the developing sleeve 14 and the the positively chargeable toner 20. A magnetic doctor blade 21 made of iron is disposed in proximity (preferably with a space of from 50 μm to 500 μm) to the surface of the cylinder and also opposingly to one of the magnetic pole positions of the multi-polar permanent magnet 140. Thus, the thickness of a toner layer 200 can be controlled to be small (preferably from 30 μm to 300 μm) and uniform so that a toner layer 200 smaller in thickness than the gap between the photosensitive drum 11 and toner carrying member 14 in the developing zone can be formed in a non-contact state. The rotational speed of this developing sleeve 14 is regulated so that the peripheral speed of the sleeve can be substantially equal or close to the speed of the peripheral speed of the photosensitive drum 11. As the magnetic doctor blade 21, a permanent magnet may be used in place of iron to form an opposing magnetic pole. In the developing zone, the AC bias or pulse bias may be applied through a bias power source 22 serving as the bias applying means, across the developing sleeve 14 and the surface of the photosensitive drum 11. As bias conditions, the AC bias may preferably have a Vpp of from 1,500 to 2,300 V and a frequency (f) of from 900 to 1,600 Hz, and the DC bias, a DC of from −100 to −350 V. When the toner 20 is moved in the developing zone formed at the part the developing sleeve (the toner carrying member) 14 and the photosensitive drum 11 becomes closest and in the vicinity thereof, the toner 20 is moved to the side of the photosensitive drum 11 in a to-and-fro movement between the developing sleeve 14 and the photosensitive drum 11 by the electrostatic force of the electrostatic image bearing member surface of the photosensitive drum 11 and the action of the AC bias or pulse bias.

In place of the magnetic doctor blade 21, an elastic blade formed of an elastic material such as silicone rubber may be used so that the layer thickness of the toner layer 200 can be controlled by pressing it against the surface of the photosensitive drum 11 and the toner layer having a given thickness may be formed on the developing sleeve 14.

As for the photosensitive drum 11, the OPC photosensitive member or drum may be replaced with an insulating drum for electrostatic recording or a photoconductive drum having a layer of a photoconductive insulating material such as α-Se, CdS, $ZnO_2$ or α-Si, any of which can be appropriately selected and used according to developing conditions.

The electrostatic image bearing member is not necessarily in the form of a drum, and may be in the form of a belt.

The electrophotographic apparatus may be constituted of a combination of plural components integrally joined as one apparatus unit from among the constituents such as the above electrostatic image bearing member, developing means, charging means and cleaning means so that the unit can be freely mounted on or detached from the body of the apparatus. For example, at least one of the group consisting of charging means, developing means and cleaning means may be integrally supported together with the electrostatic image bearing member to form one unit that can be freely mounted on or detached from the body of the apparatus, and the unit can be freely mounted or detached using a guide means such as a rail provided in the body of the apparatus. Here, any component or components not selected from the above group, e.g., the charging means and/or developing means may be set together in the body of the apparatus.

Figure 3:
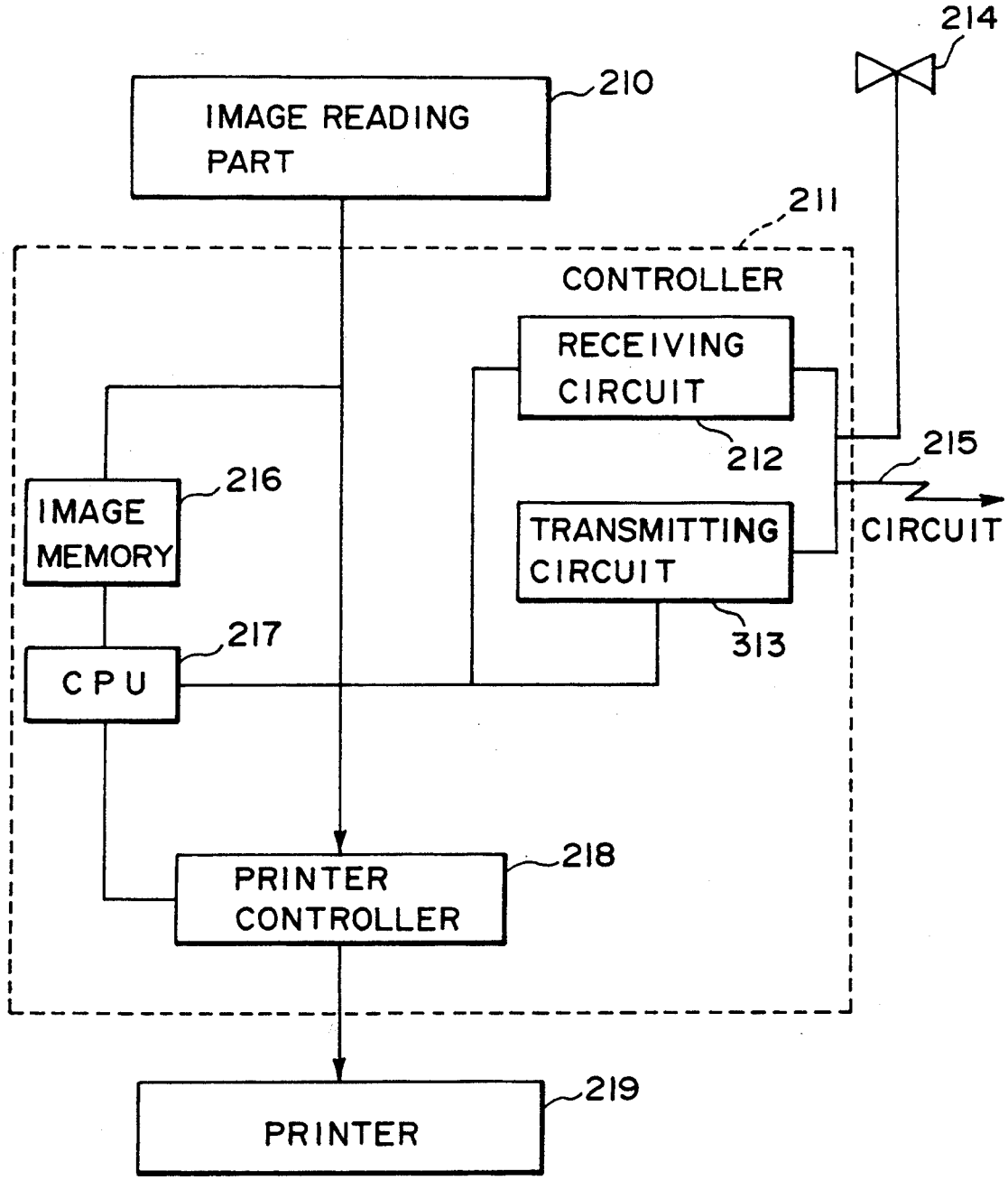
FIG. 3 is a block diagram to illustrate a facsimile apparatus in which an electrophotographic apparatus is used as a printer.

In the case when the image forming apparatus of the present invention is used as a printer of a facsimile machine, optical image exposing light 15 serving as a latent image forming means or digital exposing light comprised of laser light, is used for the printing of received data. FIG. 3 illustrates an example thereof in the form of a block diagram.

A controller 211 controls an image reading part 210 and a printer 219. The whole of the controller 211 is controlled by CPU 217. Image data outputted from the image reading part is sent to the other facsimile station through a transmitting circuit 213. Data received from the other station is sent to a printer 219 through a receiving circuit 212. Given image data are stored in an image memory 216. A printer controller 218 controls the printer 219. Reference numeral 214 denotes a telephone.

An image received from a circuit 215 (image information from a remote terminal connected through the circuit) is demodulated in the receiving circuit 212, and then successively stored in an image memory 216 after the image information is decoded by the CPU 217. Then, when images for at least one page have been stored in the memory 216, the image recording for that page is carried out. The CPU 217 reads out the image information for one page from the memory 216 and sends the coded image information for one page to the printer controller 218. The printer controller 218, having received the image information for one page from the CPU 217, controls the printer 219 so that the image information for one page is recorded.

The CPU 217 receives image information for next page in the course of the recording by the printer 219.

In the present invention, the toner for developing electrostatic images according to the present invention comprises a binder resin having as a constituent an acid component with an acid value of from 0.5 to 100 mg KOH/g, a colorant, and a specific amine type compound. Hence, it is possible to obtain fog-free, high density images not only in the case of negatively chargeable toners but also in the case of positively chargeable toners, without damage of fixing performance and anti-offset properties.

In the present invention, the toner can be less influenced by environmental variations and can give good images even in a low-humidity environment and a high-humidity environment.

The present invention will be described by giving Examples. The present invention is by no means limited by these. In the following examples, "part(s)" refers to "part(s) by weight".

Synthesis Example 1

| | |
|---|---|
| Styrene | 73 parts |
| Butyl acrylate | 24 parts |
| Monobutyl maleate | 3 parts |
| Divinylbenzene | 1 part |
| Di-tert-butyl peroxide | 0.8 part |

The above materials were dropwise added over a period of 4 hours in 200 parts of xylene heated to its reflux temperature. Then, under reflux of xylene (138° to 144° C.), the polymerization was completed, and the xylene was removed under reduced pressure while the temperature was being raised to 200° C. The resin thus obtained is designated as resin-A.

Synthesis Example 2

| | |
|---|---|
| Styrene | 73 parts |
| Butyl acrylate | 22 parts |
| Monobutyl maleate | 5 parts |
| Ethylene glycol diacrylate | 0.7 part |
| Di-tert-butyl peroxide | 1.0 part |

Using the above materials, resin-B was obtained in the same manner as in Synthesis Example 1.

Synthesis Example 3

| | |
|---|---|
| Styrene | 59 parts |
| Butyl acrylate | 23 parts |
| Monobutyl maleate | 18 parts |
| Divinylbenzene | 0.30 part |
| Azobisdimethylvaleronitrile | 0.8 part |

The above materials were dropwise added over a period of 4 hours in 200 parts of xylene heated to 80° C., followed by heating to its reflux temperature. Then, under reflux of xylene (138° to 144° C.), the polymerization was completed, and the xylene was removed under reduced pressure while the temperature was being raised to 200° C. The resin thus obtained is designated as resin-C.

Synthesis Example 4

| | |
|---|---|
| Styrene | 73 parts |
| Butyl acrylate | 24 parts |
| Monobutyl maleate | 3 parts |
| Divinylbenzene | 0.30 part |
| Benzoyl peroxide | 1.50 part |

To the above materials, 170 parts of water in which 0.12 part of polyvinyl alcohol partially saponified product had been dissolved was added, which were then vigorously stirred to give a suspension. The suspension was added to a reaction vessel holding water added in an amount of 50 parts and having been replaced with nitrogen in its inside, and then suspension polymerization was carried out at a reacton temperature of 80° C. for 8 hours. After the reaction was completed, the reaction mixture was washed with water, dehydrated and dried to give resin-D.

Comparative Synthesis Example 1

| | |
|---|---|
| Styrene | 76 parts |
| Butyl acrylate | 23 parts |
| Divinylbenzene | 0.30 part |
| Di-tert-butyl peroxide | 0.8 part |

Using the above materials, resin-E was obtained in the same manner as in Synthesis Example 1.

Acid values and physical properties of the resin-A to resin-E thus obtained are shown in Table 1.

TABLE 1

Acid Values and Physical Properties of Binder Resins

| | Total acid value of resin | JIS acid value of resin | (1) | (2) | (3)*1 | Tg*2 of resin |
|---|---|---|---|---|---|---|
| Resin-A | 14.8 | 9.6 | 5.2 | 10.4 | Present | 60.5 |
| Resin-B | 24.5 | 16.3 | 8.2 | 16.4 | Present | 62.0 |
| Resin-C | 87 | 63 | 24 | 48 | Present | 63.7 |
| Resin-D | 14.8 | 14.8 | 0 | 0 | Present | 59.8 |
| Resin-E | 0.4 | 0.4 | 0 | 0 | Absent | 61.0 |

(1): JIS acid value ascribable to acid anhydride
(2): Total acid value ascribable to acid anhydride
(3): Presence or absence of infrared absorption peak at $1,780^{-1}$ cm
*1Infrared absorption spectrum was measured using FT-IR (1600; manufactured by Perkin-Elmer Co.)
*2Tg was measured using a differential scanning calorimeter (DSC-7; manufactured by Perkin-Elmer Co.)

Example 1

| | |
|---|---|
| Resin-A | 100 parts |
| Magnetic iron oxide | 60 parts |
| Low-molecular weight polypropylene wax | 3 parts |
| Nigrosine dye | 2 parts |
| Exemplary compound (1) | 1 part |

The above materials were thoroughly premixed using a Henschel mixer, and then melt-kneaded using a twin-screw extruder set to 150° C. The kneaded product thus obtained was cooled, and then crushed with a cutter mill. Thereafter the crushed product was finely pulverized by means of a fine grinding mill making use of a jet stream. Subsequently, the finely pulverized powder thus obtained was classified using an air classifier to give a fine powder (a toner) with a volume average particle diameter of 12.3 μm.

To 100 parts of the fine powder thus obtained, 0.4 part of fine silica powder (BET surface specific area: 130 $m^2/g$) having been made hydrophobic using amino-modified silicone oil was added and the mixture was mixed using a Henschel mixer to give a toner.

This toner was applied to a modified machine of a commercially available copier (trade name: NP-6650, manufactured by Canon Inc.), so modified as to be equipped with a negatively chargeable silicone drum, and a copying test was made. Image density after copying on 300 sheets under environmental conditions of a temperature of 23° C. and a humidity of 60% RH was 1.35, and sharp images free from fog and coarseness were obtained. Copies were further taken on 10,000 sheets to examine running performance. As a result, the image density was 1.34, showing no decrease in density, and good images free from fog and coarseness and well comparable to the initial images were obtained. Results obtained under these environmental conditions are shown in Table 2.

Next, a copying test was made under environmental conditions of a temperature of 15° C. and a humidity of 10% RH. As a result, images with a high-density and a good image quality were similarly obtained. The same good results were also obtained in a 5,000 sheet copying test. Results obtained under these environmental conditions are shown in Table 3.

A copying test was also made under environmental conditions of a temperature of 35° C. and a humidity of 85% RH. As a result, images with a high-density and a good image quality were similarly obtained. The same good results were also obtained in a 5,000 sheet copying test. Results obtained under these environmental conditions are shown in Table 4.

Anti-offset properties were also evaluated.

The evaluation test machine was left to stand overnight under environmental conditions of a temperature of 15° C. and a humidity of 10% RH so that the test machine and its inside fixing assembly became adapted to the low-temperature low-humidity environment. Then, in that state, copied images were continuously obtained on 200 sheets and thereafter copied images were obtained sheet by sheet for 3 minutes at intervals of 30 seconds to examine whether or not any image stain occurred. As a result, even no offset occurred. There was also seen no toner flowing out of a cleaning member of the fixing assembly. Results of these are shown in Table 5.

| | |
|---|---|
| Resin-B | 100 parts |
| Magnetic iron oxide | 60 parts |
| Low-molecular weight polypropylene wax | 3 parts |
| Nigrosine dye | 2 parts |
| Exemplary compound (2) | 0.3 part |

Using the above materials, the procedure of Example 1 was repeated to give a fine powder (a toner) with a volume average particle diameter of 11.6 μm, followed by external addition of silica to give a toner.

Performances of this toner were evaluated in the same manner as in Example 1. Results obtained are shown in Tables 2 to 5.

Example 3

| | |
|---|---|
| Resin-C | 100 parts |
| Magnetic iron oxide | 60 parts |
| Low-molecular weight polypropylene wax | 3 parts |
| Nigrosine dye | 2 parts |
| Exemplary compound (5) | 0.3 part |

Using the above materials, the procedure of Example 1 was repeated to give a fine powder (a toner) with a volume average particle diameter of 11.7 μm, followed by external addition of silica to give a toner.

Performances of this toner were evaluated in the same manner as in Example 1. Results obtained are shown in Tables 2 to 5.

Example 4

| | |
|---|---|
| Resin-B | 100 parts |
| Magnetic iron oxide | 60 parts |
| Low-molecular weight polypropylene wax | 3 parts |
| Nigrosine dye | 2 parts |
| Exemplary compound (9) | 2 parts |

Using the above materials, the procedure of Example 1 was repeated to give a fine powder (a toner) with a volume average particle diameter of 12.1 μm, followed by external addition of silica to give a toner.

Performances of this toner were evaluated in the same manner as in Example 1. Results obtained are shown in Tables 2 to 5.

Example 5

| | |
|---|---|
| Resin-B | 100 parts |
| Magnetic iron oxide | 60 parts |
| Low-molecular weight polypropylene wax | 3 parts |
| Nigrosine dye | 2 parts |
| Exemplary compound (10) | 2 parts |

Using the above materials, the procedure of Example 1 was repeated to give a fine powder (a toner) with a volume average particle diameter of 12.0 μm, followed by external addition of silica to give a toner.

Performances of this toner were evaluated in the same manner as in Example 1. Results obtained are shown in Tables 2 to 5.

Example 6

| | |
|---|---|
| Resin-D | 100 parts |
| Magnetic iron oxide | 60 parts |
| Low-molecular weight polypropylene wax | 3 parts |
| Nigrosine dye | 2 parts |
| Exemplary compound (4) | 1 part |

Using the above materials, the procedure of Example 1 was repeated to give a fine powder (a toner) with a volume average particle diameter of 11.9 μm, followed by external addition of silica to give a toner.

Performances of this toner were evaluated in the same manner as in Example 1. Results obtained are shown in Tables 2 to 5.

Example 7

| | |
|---|---|
| Resin-C | 100 parts |
| Magnetic iron oxide | 60 parts |
| Low-molecular weight polypropylene wax | 3 parts |
| Chromium complex of monoazo dye | 2 parts |
| Exemplary compound (1) | 1 part |

Using the above materials, the procedure of Example 1 was repeated to give a fine powder (a toner) with a volume average particle diameter of 11.7 μm.

To 100 parts of the fine powder thus obtained, 0.4 part of fine silica powder (BET surface specific area: 300 $m^2/g$) having been made hydrophobic using hexamethyldisilazane was added and the mixture was mixed using a Henschel mixer to give a toner.

This toner was applied to a commercially available copier (trade name: NP-6650, manufactured by Canon Inc.), and evaluation tests were made in the same manner as in Example 1. Results obtained are shown in Tables 2 to 5.

Comparative Example 1

| | |
|---|---|
| Resin-E | 100 parts |
| Magnetic iron oxide | 60 parts |
| Low-molecular weight polypropylene wax | 3 parts |
| Nigrosine dye | 2 parts |
| Exemplary compound (1) | 1 part |

Using the above materials, the procedure of Example 1 was repeated to give a fine powder (a toner) with a volume average particle diameter of 11.9 μm, followed by external addition of silica to give a toner.

Performances of this toner were evaluated in the same manner as in Example 1. Results obtained are shown in Tables 2 to 5.

Comparative Example 2

| | |
|---|---|
| Resin-C | 100 parts |
| Magnetic iron oxide | 60 parts |
| Low-molecular weight polypropylene wax | 3 parts |
| Nigrosine dye | 2 parts |

Using the above materials, the procedure of Example 1 was repeated to give a fine powder (a toner) with a volume average particle diameter of 11.8 μm, followed by external addition of silica to give a toner.

Performances of this toner were evaluated in the same manner as in Example 1. Results obtained are shown in Tables 2 to 5.

Comparative Example 3

| | |
|---|---|
| Resin-C | 100 parts |
| Magnetic iron oxide | 60 parts |
| Low-molecular weight polypropylene wax | 3 parts |
| Nigrosine dye | 2 parts |
| Chromium complex of di-tert-butylsalicylic acid | 1 part |

Using the above materials, the procedure of Example 1 was repeated to give a fine powder (a toner) with a volume average particle diameter of 12.0 μm, followed by external addition of silica to give a toner.

Performances of this toner were evaluated in the same manner as in Example 1. Results obtained are shown in Tables 2 to 5.

TABLE 2

| | Image Evaluation under 23° C./60% RH | | | | |
|---|---|---|---|---|---|
| | Binder resin | Initial stage | | On 10,000th sheet | |
| | | Image density | Fog | Image density | Fog |
| Example: | | | | | |
| 1 | Resin-A | 1.35 | AA | 1.34 | AA |
| 2 | Resin-B | 1.34 | AA | 1.32 | A |
| 3 | Resin-C | 1.31 | A | 1.29 | A |
| 4 | Resin-B | 1.33 | AA | 1.32 | AA |
| 5 | Resin-B | 1.33 | AA | 1.30 | A |
| 6 | Resin-D | 1.34 | AA | 1.32 | A |
| 7 | Resin-C | 1.33 | AA | 1.32 | AA |
| Comparative Example: | | | | | |
| 1 | Resin-E | 1.34 | AA | 1.32 | AA |
| 2 | Resin-C | 1.30 | AA | 1.28 | A |
| 3 | Resin-C | 1.20 | B | 1.07 | C |

AA: Excellent
A: Good
B: Passable
C: Failure

TABLE 3

| | Image Evaluation under 15° C./10% RH | | | | |
|---|---|---|---|---|---|
| | Binder resin | Initial stage | | On 5,000th sheet | |
| | | Image density | Fog | Image density | Fog |
| Example: | | | | | |
| 1 | Resin-A | 1.36 | AA | 1.36 | AA |
| 2 | Resin-B | 1.35 | AA | 1.33 | AA |
| 3 | Resin-C | 1.32 | A | 1.31 | A |
| 4 | Resin-B | 1.35 | AA | 1.33 | AA |
| 5 | Resin-B | 1.35 | AA | 1.32 | AA |
| 6 | Resin-D | 1.35 | AA | 1.33 | AA |
| 7 | Resin-C | 1.35 | AA | 1.34 | AA |
| Comparative Example: | | | | | |
| 1 | Resin-E | 1.36 | AA | 1.34 | AA |
| 2 | Resin-C | 1.31 | A | 1.29 | A |
| 3 | Resin-C | 1.23 | C | 1.12 | C |

AA: Excellent
A: Good
B: Passable
C: Failure

TABLE 4

| | Image Evaluation under 32.5° C./85% RH | | | | |
|---|---|---|---|---|---|
| | Binder resin | Initial stage | | On 5,000th sheet | |
| | | Image density | Fog | Image density | Fog |
| Example: | | | | | |
| 1 | Resin-A | 1.34 | AA | 1.33 | AA |
| 2 | Resin-B | 1.32 | AA | 1.30 | A |
| 3 | Resin-C | 1.29 | A | 1.27 | B |
| 4 | Resin-B | 1.32 | AA | 1.29 | A |
| 5 | Resin-B | 1.32 | AA | 1.30 | A |
| 6 | Resin-D | 1.32 | AA | 1.31 | A |
| 7 | Resin-C | 1.32 | AA | 1.30 | AA |
| Comparative Example: | | | | | |
| 1 | Resin-E | 1.33 | AA | 1.32 | AA |
| 2 | Resin-C | 1.29 | A | 1.27 | B |
| 3 | Resin-C | 1.12 | C | 1.02 | C |

AA: Excellent
A: Good
B: Passable
C: Failure

TABLE 5

| Anti-offset properties | |
|---|---|
| Example 1 | AA |
| Example 2 | AA |
| Example 3 | AA |

TABLE 5-continued

| Anti-offset properties | |
|---|---|
| Example 4 | A |
| Example 5 | B |
| Example 6 | A |
| Example 7 | A |
| Comparative Example 1 | C |
| Comparative Example 2 | C |
| Comparative Example 3 | A |

AA: Excellent
A: Good
B: Passable
C: Failure

Synthesis Example 5

| | |
|---|---|
| Styrene | 73 parts |
| Butyl acrylate | 24 parts |
| Monobutyl maleate | 3 parts |
| Divinylbenzene | 0.30 part |
| Di-tert-butyl peroxide | 0.8 part |

The above materials were dropwise added over a period of 4 hours in 200 parts of xylene heated to its reflux temperature. Then, under reflux of xylene (138° to 144° C.), the polymerization was completed, and the xylene was removed under reduced pressure while the temperature was being raised to 200° C. The resin thus obtained is designated as resin-F.

Synthesis Example 6

| | |
|---|---|
| Styrene | 73 parts |
| Butyl acrylate | 22 parts |
| Monobutyl maleate | 5 parts |
| Di-tert-butyl peroxide | 1.0 part |

Using the above materials, resin-G was obtained in the same manner as in Synthesis Example 1.

Synthesis Example 7

| | |
|---|---|
| Styrene | 59 parts |
| Butyl acrylate | 23 parts |
| Monobutyl maleate | 18 parts |
| Divinylbenzene | 0.30 part |
| Azobisdimethylvaleronitrile | 0.8 part |

The above materials were dropwise added over a period of 4 hours in 200 parts of xylene heated to 80° C., followed by heating to its reflux temperature. Then, under reflux of xylene (138° to 144° C.), the polymerization was completed, and the xylene was removed under reduced pressure while the temperature was being raised to 200° C. The resin thus obtained is designated as resin-H.

Synthesis Example 8

| | |
|---|---|
| Styrene | 73 parts |
| Butyl acrylate | 24 parts |
| Monobutyl maleate | 3 parts |
| Divinylbenzene | 0.30 part |
| Benzoyl peroxide | 0.80 part |

To the above materials, 170 parts of water in which 0.12 part of polyvinyl alcohol partially saponified product had been dissolved was added, which were then vigorously stirred to give a suspension. The suspension was added to a reaction vessel holding water added in an amount of 50 parts and having been replaced with nitrogen in its inside, and then suspension polymerization was carried out at a reaction temperature of 80° C. for 8 hours. After the reaction was completed, the reaction mixture was washed with water, dehydrated and dried to give resin-I.

Comparative Synthesis Example 2

| | |
|---|---|
| Styrene | 76 parts |
| Butyl acrylate | 23 parts |
| Divinylbenzene | 0.30 part |
| Di-tert-butyl peroxide | 0.8 part |

Using the above materials, resin-J was obtained in the same manner as in Synthesis Example 1.

Acid values and physical properties of the resin-F to resin-J thus obtained are shown in Table 6.

TABLE 6

Acid Values and Physical Properties of Binder Resins

| | Total acid value of resin | JIS acid value of resin | (1) | (2) | (3)*1 | Tg*2 of resin |
|---|---|---|---|---|---|---|
| Resin-F | 14.8 | 9.6 | 5.2 | 10.4 | Present | 60.5 |
| Resin-G | 24.5 | 16.3 | 8.2 | 16.4 | Present | 62.0 |
| Resin-H | 87 | 58 | 29 | 58 | Present | 63.7 |
| Resin-I | 14.8 | 14.8 | 0 | 0 | Present | 59.8 |
| Resin-J | 0.5 | 0.5 | 0 | 0 | Absent | 61.0 |

(1): JIS acid value ascribable to acid anhydride
(2): Total acid value ascribable to acid anhydride
(3): Presence or absence of infrared absorption peak at $1,780^{-1}$ cm
*1Infrared absorption spectrum was measured using FT-IR (1600; manufactured by Perkin-Elmer Co.)
*2Tg was measured using a differential scanning calorimeter (DSC-7; manufactured by Perkin-Elmer Co.)

Example 8

| | |
|---|---|
| Resin-F | 100 parts |
| Magnetic iron oxide | 60 parts |
| Low-molecular weight polypropylene wax | 3 parts |
| Nigrosine dye | 2 parts |
| Exemplary compound (27) | 0.5 part |

The above materials were thoroughly premixed using a Henschel mixer, and then melt-kneaded for using a twin-screw extruder set to 140° C. The kneaded product thus obtained was cooled, and then crushed with a cutter mill. Thereafter the crushed product was finely pulverized by means of a fine grinding mill making use of a jet stream. Subsequently, the finely pulverized powder thus obtained was classified using an air classifier to give a fine powder (a toner) with a volume average particle diameter of 11.5 μm.

To 100 parts of the fine powder thus obtained, 0.4 part of fine silica powder (BET surface specific area: 130 $m^2/g$) having been made hydrophobic using amino-modified silicone oil was added and the mixture was mixed using a Henschel mixer to give a toner.

This toner was applied to a modified machine of a commercially available copier (trade name: NP-6650, manufactured by Canon Inc.), so modified as to be equipped with a negatively chargeable silicone drum, and a copying test was made. Image density after copying on 100 sheets under environmental conditions of a temperature of 23° C. and a humidity of 60% RH was 1.39, and sharp images free from fog and coarseness were obtained. Copies were further taken on 10,000 sheets to examine running performance. As a result, the image density was 1.38, showing no decrease in density, and good images free from fog and coarseness and well comparable to the initial images were obtained. Results obtained under these environmental conditions are shown in Table 7.

Next, a copying test was made under environmental conditions of a temperature of 15° C. and a humidity of 10% RH. As a result, images with a high-density and a good image quality were similarly obtained. The same good results were also obtained in a 5,000 sheet copying test. Results obtained under these environmental conditions are shown in Table 8.

A copying test was also made under environmental conditions of a temperature of 35° C. and a humidity of 85% RH. As a result, images with a high-density and a good image quality were similarly obtained. The same good results were also obtained in a 5,000 sheet copying test. Results obtained under these environmental conditions are shown in Table 9.

Anti-offset properties were also evaluated.

The evaluation test machine was left to stand overnight under environmental conditions of a temperature of 15° C. and a humidity of 10% RH so that the test machine and its inside fixing assembly became adapted to the low-temperature low-humidity environment. Then, in that state, copied images were continuously obtained on 200 sheets and thereafter copied images were obtained sheet by sheet for 3 minutes at intervals of 30 seconds to examine whether or not any image stain occurred. As a result, no offset also occurred. Moreover, no toner flowed out of a cleaning member of the fixing assembly. Results of these are shown in Table 10.

Example 9

| | |
|---|---|
| Resin-F | 100 parts |
| Magnetic iron oxide | 60 parts |
| Low-molecular weight polypropylene wax | 3 parts |
| Nigrosine dye | 2 parts |
| Exemplary compound (30) | 1 part |

Using the above materials, the procedure of Example 8 was repeated to give a fine powder (a toner) with a volume average particle diameter of 11.7 μm, followed by external addition of silica to give a toner.

Performances of this toner were evaluated in the same manner as in Example 8. Results obtained are shown in Tables 7 to 10.

Example 10

| | |
|---|---|
| Resin-G | 100 parts |
| Magnetic iron oxide | 60 parts |
| Low-molecular weight polypropylene wax | 3 parts |
| Nigrosine dye | 2 parts |
| Exemplary compound (40) | 0.5 part |

Using the above materials, the procedure of Example 8 was repeated to give a fine powder (a toner) with a volume average particle diameter of 7.7 μm, followed by external addition of silica to give a toner.

Performances of this toner were evaluated in the same manner as in Example 8. Results obtained are shown in Tables 7 to 10.

Example 11

| | |
|---|---|
| Resin-H | 100 parts |
| Magnetic iron oxide | 60 parts |
| Low-molecular weight polypropylene wax | 3 parts |
| Nigrosine dye | 2 parts |
| Exemplary compound (19) | 1 part |

Using the above materials, the procedure of Example 8 was repeated to give a fine powder (a toner) with a volume average particle diameter of 11.8 μm, followed by external addition of silica to give a toner.

Performances of this toner were evaluated in the same manner as in Example 8. Results obtained are shown in Tables 7 to 10.

Example 12

| | |
|---|---|
| Resin-I | 100 parts |
| Magnetic iron oxide | 60 parts |
| Low-molecular weight polypropylene wax | 3 parts |
| Nigrosine dye | 2 parts |
| Exemplary compound (37) | 1 part |

Using the above materials, the procedure of Example 8 was repeated to give a fine powder (a toner) with a volume average particle diameter of 11.7 μm, followed by external addition of silica to give a toner.

Performances of this toner were evaluated in the same manner as in Example 8. Results obtained are shown in Tables 7 to 10.

Example 13

| | |
|---|---|
| Resin-H | 100 parts |
| Magnetic iron oxide | 60 parts |
| Low-molecular weight polypropylene wax | 3 parts |
| Nigrosine dye | 2 parts |
| Exemplary compound (46) | 0.5 part |

Using the above materials, the procedure of Example 8 was repeated to give a fine powder (a toner) with a volume average particle diameter of 11.6 μm, followed by external addition of silica to give a toner.

To 100 parts of the fine powder thus obtained, 0.4 part of fine silica powder (BET surface specific area: 300 $m^2/g$) having been made hydrophobic using hexamethyldisilazane was added and the mixture was mixed using a Henschel mixer to give a toner.

This toner was applied to a commercially available copier (trade name: NP-6650, manufactured by Canon Inc.), and evaluation tests were made in the same manner as in Example 8. Results obtained are shown in Tables 7 to 10.

Comparative Example 4

| | |
|---|---|
| Resin-J | 100 parts |
| Magnetic iron oxide | 60 parts |
| Low-molecular weight polypropylene wax | 3 parts |
| Nigrosine dye | 2 parts |
| Exemplary compound (27) | 1 part |

Using the above materials, the procedure of Example 8 was repeated to give a fine powder (a toner) with a volume average particle diameter of 11.7 μm, followed by external addition of silica to give a toner.

Performances of this toner were evaluated in the same manner as in Example 8. Results obtained are shown in Tables 7 to 10.

Comparative Example 5

| | |
|---|---|
| Resin-H | 100 parts |
| Magnetic iron oxide | 60 parts |
| Low-molecular weight polypropylene wax | 3 parts |
| Nigrosine dye | 2 parts |

Using the above materials, the procedure of Example 8 was repeated to give a fine powder (a toner) with a volume average particle diameter of 11.8 μm, followed by external addition of silica to give a toner.

Performances of this toner were evaluated in the same manner as in Example 8. Results obtained are shown in Tables 7 to 10.

Comparative Example 6

| | |
|---|---|
| Resin-H | 100 parts |
| Magnetic iron oxide | 60 parts |
| Low-molecular weight polypropylene wax | 3 parts |
| Nigrosine dye | 2 parts |
| Chromium complex of di-tert-butylsalicylic acid | 1 part |

Using the above materials, the procedure of Example 8 was repeated to give a fine powder (a toner) with a volume average particle diameter of 12.0 μm, followed by external addition of silica to give a toner.

Performances of this toner were evaluated in the same manner as in Example 8. Results obtained are shown in Tables 7 to 10.

TABLE 7

| | Image Evaluation under 23° C./60% RH | | | | |
|---|---|---|---|---|---|
| | Binder | Initial stage | | On 10,000th sheet | |
| | resin | Image density | Fog | Image density | Fog |
| Example: | | | | | |
| 8 | Resin-F | 1.39 | AA | 1.38 | AA |
| 9 | Resin-F | 1.38 | AA | 1.37 | AA |
| 10 | Resin-G | 1.37 | AA | 1.36 | AA |
| 11 | Resin-H | 1.36 | AA | 1.34 | A |
| 12 | Resin-I | 1.36 | AA | 1.35 | A |
| 13 | Resin-H | 1.38 | AA | 1.38 | AA |
| Comparative Example: | | | | | |
| 4 | Resin-J | 1.36 | AA | 1.35 | AA |
| 5 | Resin-H | 1.33 | AA | 1.31 | A |
| 6 | Resin-H | 1.23 | B | 1.10 | C |

AA: Excellent
A: Good
B: Passable
C: Failure

TABLE 8

| | Image Evaluation under 15° C./10% RH | | | | |
|---|---|---|---|---|---|
| | Binder | Initial stage | | On 5,000th sheet | |
| | resin | Image density | Fog | Image density | Fog |
| Example: | | | | | |
| 8 | Resin-F | 1.40 | AA | 1.40 | AA |
| 9 | Resin-F | 1.39 | AA | 1.39 | AA |
| 10 | Resin-G | 1.38 | AA | 1.37 | AA |
| 11 | Resin-H | 1.36 | AA | 1.35 | A |
| 12 | Resin-I | 1.37 | AA | 1.37 | AA |
| 13 | Resin-H | 1.38 | AA | 1.39 | AA |
| Comparative Example: | | | | | |

TABLE 8-continued

| | Image Evaluation under 15° C./10% RH | | | | |
|---|---|---|---|---|---|
| | Binder | Initial stage | | On 5,000th sheet | |
| | resin | Image density | Fog | Image density | Fog |
| 4 | Resin-J | 1.39 | AA | 1.39 | AA |
| 5 | Resin-H | 1.34 | A | 1.32 | A |
| 6 | Resin-H | 1.26 | C | 1.15 | C |

AA: Excellent
A: Good
B: Passable
C: Failure

TABLE 9

| | Image Evaluation under 32.5° C./85% RH | | | | |
|---|---|---|---|---|---|
| | Binder | Initial stage | | On 5,000th sheet | |
| | resin | Image density | Fog | Image density | Fog |
| Example: | | | | | |
| 8 | Resin-F | 1.38 | AA | 1.38 | AA |
| 9 | Resin-F | 1.37 | AA | 1.37 | A |
| 10 | Resin-G | 1.25 | AA | 1.34 | A |
| 11 | Resin-H | 1.33 | A | 1.32 | B |
| 12 | Resin-I | 1.35 | AA | 1.33 | A |
| 13 | Resin-H | 1.36 | AA | 1.36 | AA |
| Comparative Example: | | | | | |
| 4 | Resin-J | 1.36 | AA | 1.36 | AA |
| 5 | Resin-H | 1.32 | A | 1.30 | B |
| 6 | Resin-H | 1.15 | C | 1.05 | C |

AA: Excellent
A: Good
B: Passable
C: Failure

TABLE 10

| | Anti-offset properties |
|---|---|
| Example 8 | AA |
| Example 9 | A |
| Example 10 | AA |
| Example 11 | AA |
| Example 12 | B |
| Example 13 | AA |
| Comparative Example 4 | C |
| Comparative Example 5 | C |
| Comparative Example 6 | A |

AA: Excellent
A: Good
B: Passable
C: Failure

Synthesis Example 9

| | |
|---|---|
| Styrene | 70.0 parts |
| n-Butyl acrylate | 20.0 parts |
| Monobutyl maleate | 10.0 parts |
| 2,2-Bis(4,4-di-tert-butylperoxycyclohexyl)propane | 0.3 part |

The above materials were dropwise added in 200 parts of heated xylene over a period of 4 hours. Then, under reflux of xylene, the polymerization was completed.

| | |
|---|---|
| Styrene | 83.0 parts |
| n-Butyl acrylate | 17.0 parts |
| Di-tert-butyl peroxide | 1.0 part |

The above materials were dropwise added in 200 parts of heated xylene over a period of 4 hours. Then, under reflux of xylene, the polymerization was completed, and the resulting solutions were mixed in a proportion of 3:7 in weight ratio of the resin component in the former to that in the latter. Thereafter, the solvent was removed under reduced pressure while the temperature was being raised to 200° C. The resin thus obtained is designated as resin-K.

Synthesis Example 10

| | |
|---|---|
| Styrene | 73.0 parts |
| n-Butyl acrylate | 20.0 parts |
| Monobutyl maleate | 7.0 parts |
| 2,2-Bis(4,4-di-tert-butylperoxyclohexyl)propane | 0.3 part |

The above materials were dropwise added in 200 parts of heated xylene over a period of 4 hours. Then, under reflux of xylene, the polymerization was completed.

| | |
|---|---|
| Styrene | 77.0 parts |
| n-Butyl acrylate | 18.0 parts |
| Monobutyl maleate | 5.0 parts |
| Di-tert-butyl peroxide | 1.0 part |

The above materials were dropwise added in 200 parts of heated xylene over a period of 4 hours. Then, under reflux of xylene, the polymerization was completed, and the resulting solutions were mixed in a proportion of 4:6 in weight ratio of the resin component in the former to that in the latter. Thereafter, the solvent was removed under reduced pressure while the temperature was being raised to 200° C. The resin thus obtained is designated as resin-L.

Synthesis Example 11

| | |
|---|---|
| Styrene | 82.0 parts |
| n-Butyl acrylate | 18.0 parts |
| Di-tert-butyl peroxide | 0.8 part |

The above materials were dropwise added in 200 parts of heated xylene over a period of 4 hours. Then, under reflux of xylene, the polymerization was completed, and the solvent was removed under reduced pressure while the temperature was being raised to 200° C. A resin was thus obtained.

| | |
|---|---|
| Styrene | 75.0 parts |
| n-Butyl acrylate | 20.0 parts |
| Monobutyl maleate | 5.0 parts |
| 1,1-Bis(tert-butylperoxy)-3,3,5-trimethylcyclohexane | 0.2 parts |

The above materials were dropwise added in 200 parts of heated xylene over a period of 4 hours. Then, under reflux of xylene, the polymerization was completed to give another resin. This resin, a polyester resin (a condensation polymerization product comprised of bisphenol-A, terephthalic acid, n-dodecenylsuccinic acid, trimellitic acid and diethylene glycol in a proportion of 20:38:10:5:27; Mn: 5,000; Mw: 50,000; Tg: 59° C.; acid value: 11.0) and the first-mentioned resin were thoroughly mixed in a solution so as for their resin components are in a proportion of 4:3:3. Thereafter, the solvent was removed under reduced pressure while the temperature was being raised to 200° C. The resin thus obtained is designated as resin-M.

Synthesis Example 12

| | |
|---|---|
| Styrene | 77.0 parts |
| n-Butyl acrylate | 20.0 parts |
| Acrylic acid | 3.0 parts |
| 2,2-Azobis(2,4-dimethylvaleronitrile) | 0.2 part |

The above materials were dropwise added in 200 parts of heated xylene over a period of 4 hours. Then, under reflux of xylene, the polymerization was completed, and the solvent was removed under reduced pressure while the temperature was being raised to 200° C. The resin thus obtained is designated as resin-n.

| | |
|---|---|
| Resin-n | 30.0 parts |
| Styrene | 57.4 parts |
| n-Butyl acrylate | 12.6 parts |
| Di-tert-butyl peroxide | 0.6 part |

The above materials were dropwise added in 200 parts of heated xylene over a period of 4 hours. Then, under reflux of xylene, the polymerization was completed, and the solvent was removed under reduced pressure while the temperature was being raised to 200° C. The resin thus obtained is designated as resin-N.

Synthesis Example 13

| | |
|---|---|
| Styrene | 74.0 parts |
| n-Butyl acrylate | 21.0 parts |
| Monobutyl maleate | 5.0 parts |
| Tris(tert-butylperoxy)triazine | 0.4 part |

To the above materials, 170 parts of water in which 0.12 part of polyvinyl alcohol partially saponified product had been dissolved was added, which were then vigorously stirred to give a suspension. The suspension was added to a reaction vessel holding water added in an amount of 50 parts and having been replaced with nitrogen in its inside, and then suspension polymerization was carried out at a reaction temperature of 80° C. for 8 hours. After the reaction was completed, the reaction mixture was washed with water, dehydrated and dried to give suspension polymerization pearls.

| | |
|---|---|
| Styrene | 82.0 parts |
| n-Butyl acrylate | 18.0 parts |
| Di-tert-butyl peroxide | 0.8 part |

The above materials were dropwise added in 200 parts of heated xylene over a period of 4 hours. Then, under reflux of xylene, the polymerization was completed. The resulting resins were mixed in a solution in a proportion of 2:8 in weight ratio of the resin component in the former (suspension polymerization pearls) to that in the latter (solution polymerization product). Thereafter, the solvent was removed under reduced pressure while the temperature was being raised to 200° C. The resin thus obtained is designated as resin-O.

Synthesis Example 14

| | |
|---|---|
| Styrene | 77.0 parts |
| n-Butyl acrylate | 20.0 parts |
| Monobutyl maleate | 3.0 parts |

-continued

| | |
|---|---|
| 1,4-Bis(tert-butylperoxycarbonyl)cyclohexane | 0.5 part |

To the above materials, 170 parts of water in which 0.12 part of polyvinyl alcohol partially saponified product had been dissolved was added, which were then vigorously stirred to give a suspension. The suspension was added to a reaction vessel holding water added in an amount of 50 parts and having been replaced with nitrogen in its inside, and then suspension polymerization was carried out at a reaction temperature of 80° C. for 8 hours. After the reaction was completed, the reaction mixture was washed with water, dehydrated and dried to give suspension polymerization pearls.

| | |
|---|---|
| Styrene | 82.0 parts |
| n-Butyl acrylate | 17.0 parts |
| Monobutyl maleate | 1.0 part |
| Di-tert-butyl peroxide | 1.0 part |

The above materials were dropwise added in 200 parts of heated xylene over a period of 4 hours. Then, under reflux of xylene, the polymerization was completed. The resulting resins were mixed in a solution in a proportion of 3:7 in weight ratio of the resin component in the former (suspension polymerization pearls) to that in the latter (solution polymerization product). Thereafter, the solvent was removed under reduced pressure while the temperature was being raised to 200° C. The resin thus obtained is designated as resin-P.

Synthesis Example 15

| | |
|---|---|
| Styrene | 86.0 parts |
| n-Butyl acrylate | 14.0 parts |
| Di-tert-butyl peroxide | 1.2 parts |

The above materials were dropwise added in 200 parts of heated xylene over a period of 4 hours. Then, under reflux of xylene, the polymerization was completed, and the solvent was removed under reduced pressure while the temperature was being raised to 200° C. The resin thus obtained is designated as resin-q.

| | |
|---|---|
| Resin-q | 50.0 parts |
| Styrene | 38.0 parts |
| n-Butyl acrylate | 10.0 parts |
| Monobutyl maleate | 4.0 parts |
| 2,2-Azobis(2,4-dimethylvaleronitrile) | 0.2 part |

To the above materials, 170 parts of water in which 0.12 part of polyvinyl alcohol partially saponified product had been dissolved was added, which were then vigorously stirred to give a suspension. The suspension was added to a reaction vessel holding water added in an amount of 50 parts and having been replaced with nitrogen in its inside, and then suspension polymerization was carried out at a reaction temperature of 80° C. for 8 hours. After the reaction was completed, the reaction mixture was washed with water, dehydrated and dried to give suspension polymerization pearls. The resin thus obtained is designated as resin-Q.

Comparative Synthesis Example 3

| | |
|---|---|
| Styrene | 80.0 parts |
| n-Butyl acrylate | 20.0 parts |
| 2,2-Bis(4,4-di-tert-butylperoxycyclohexyl)propane | 0.3 part |

The above materials were dropwise added in 200 parts of heated xylene over a period of 4 hours. Then, under reflux of xylene, the polymerization was completed.

| | |
|---|---|
| Styrene | 83.0 parts |
| n-Butyl acrylate | 17.0 parts |
| Di-tert-butyl peroxide | 1.0 part |

The above materials were dropwise added in 200 parts of heated xylene over a period of 4 hours. Then, under reflux of xylene, the polymerization was completed, and the resulting solutions were mixed in a proportion of 3:7 in weight ratio of the resin component in the former to that in the latter. Thereafter, the solvent was removed under reduced pressure while the temperature was being raised to 200° C. The resin thus obtained is designated as resin-R.

Synthesis Example 16

| | |
|---|---|
| Styrene | 70.0 parts |
| n-Butyl acrylate | 20.0 parts |
| Monobutyl maleate | 10.0 parts |
| 2,2-Bis(4,4-di-tert-butylperoxycyclohexyl)propane | 0.3 part |

The above materials were dropwise added in 200 parts of heated xylene over a period of 4 hours. Then, under reflux of xylene, the polymerization was completed.

| | |
|---|---|
| Styrene | 83.0 parts |
| n-Butyl acrylate | 17.0 parts |
| 2,2-Azobisbutylonitrile) | 0.8 part |

The above materials were dropwise added in 200 parts of heated xylene over a period of 4 hours. Then, under reflux of xylene, the polymerization was completed, and the resulting solutions were mixed in a proportion of 3:7 in weight ratio of the resin component in the former to that in the latter. Thereafter, the solvent was removed under reduced pressure while the temperature was being raised to 200° C. The resin thus obtained is designated as resin-S.

Synthesis Example 17

| | |
|---|---|
| Styrene | 77.0 parts |
| n-Butyl acrylate | 18.0 parts |
| Monobutyl maleate | 5.0 parts |
| Di-tert-butyl peroxide | 1.0 part |

The above materials were dropwise added in 200 parts of heated xylene over a period of 4 hours. Then, under reflux of xylene, the polymerization was completed. The solvent was removed under reduced pressure while the temperature was being raised to 200° C. The resin thus obtained is designated as resin-T.

Acid values and physical properties of the resin-K to resin-T thus obtained are shown in Table 11.

TABLE 11

Acid Values and Physical Properties of Binder Resins

| | Total acid value of resin | JIS acid value of resin | (1) | (2) | (3)*1 | Tg*2 of resin |
|---|---|---|---|---|---|---|
| Resin-K | 15.8 | 9.8 | 6.0 | 12.0 | Present | 58.5 |
| Resin-L | 31.4 | 18.9 | 12.5 | 25.0 | Present | 58.0 |
| Resin-M | 13.2 | 9.7 | 3.5 | 7.0 | Present | 58.2 |
| Resin-N | 7.0 | 7.0 | 0 | 0 | Absent | 57.5 |
| Resin-O | 4.9 | 3.3 | 1.6 | 3.2 | Present | 58.3 |
| Resin-P | 8.3 | 5.2 | 3.1 | 6.2 | Present | 57.8 |
| Resin-Q | 6.5 | 6.5 | 0 | 0 | Absent | 58.7 |
| Resin-R | 0.1 | 0.1 | 0 | 0 | Absent | 57.7 |
| Resin-S | 15.5 | 9.7 | 5.8 | 11.6 | Present | 58.4 |
| Resin-T | 26.4 | 16.4 | 10.0 | 20.0 | Present | 57.1 |

(1): JIS acid value ascribable to acid anhydride
(2): Total acid value ascribable to acid anhydride
(3): Presence or absence of infrared absorption peak at $1,780^{-1}$ cm
*1Infrared absorption spectrum was measured using FT-IR (1600; manufactured by Perkin-Elmer Co.)
*2Tg was measured using a differential scanning calorimeter (DSC-7; manufactured by Perkin-Elmer Co.)

Example 14

| | |
|---|---|
| Resin-K | 100 parts |
| Magnetic iron oxide | 80 parts |
| Low-molecular weight ethylene-propylene copolymer | 3 parts |
| Exemplary compound (1) | 1 part |
| Nigrosine dye | 2 parts |

The above materials were premixed and thereafter melt-kneaded using a twin-screw extruder set to 130° C. The kneaded product obtained was cooled and then crushed. Thereafter the crushed product was finely pulverized by means of a grinding mill making use of a jet stream. Subsequently, the finely pulverized powder obtained was classified using an air classifier to give a positively chargeable fine powder (a toner) with a volume average particle diameter of 8 μm.

Molecular weight distribution was measured by GPC using a high-speed liquid chromatograph 150C, available from Waters Co. Columns used were comprised of a combination of Shodex GPC KF-801, KF-802, KF-803, KF-804, KF-805, KF-806, KF-807 and KF-800P, available from Showa Denko K.K. The sample was so prepared as to have resin components in a concentration of 5 mg/ml. Molecular weight distribution of the resin components in this fine powder is shown in Table 12, in which only the largest peak value is set out.

To 100 parts of the fine powder thus obtained, 0.6 part of hydrophobic colloidal silica was externally added to give a positively chargeable toner. This toner was applied to a modified machine of a commercially available electrophotographic copier NP-8580 (trade name; manufactured by Canon Inc.), so modified as to be equipped with a negatively chargeable amorphous silicone drum to make it possible to use the positively chargeable toner. Using this copier, fixing performance, toner flow-out preventive properties, image quality and durability (or running performance) were evaluated. Results of this copying test are shown in Table 13. Throughout the copying test, fog-free images were obtained with an always stable high density (1.30 to 1.35). Images were also confirmed to be faithful to an original, as having excellent halftone reproduction and line reproduction. Images fixed using a fixing assembly controlled to be set at a temperature of 160° C. were used to evaluate the fixing performance. To evaluate the fixing performance, the images were rubbed 10 times with Silbon paper under application of a load of about 100 g to examine wear-off of images, and its degree was indicated as percentage (%) of decrease in reflection density. To evaluate the toner flow-out preventive properties, copied images were continuously obtained on 200 sheets and thereafter copied images were obtained sheet by sheet for 3 minutes at intervals of 30 seconds to examine whether or not any image stain occurred. The fixing performance was found good and also no offset occurred. There also was seen no toner flowing out of a cleaning member of the fixing assembly.

Example 15

| | |
|---|---|
| Resin-L | 100 parts |
| Magnetic iron oxide | 80 parts |
| Low-molecular weight ethylene-propylene copolymer | 3 parts |
| Exemplary compound (2) | 1 part |
| Azochromium complex | 2 parts |

Using the above materials, the procedure of Example 14 was repeated to give a negatively chargeable fine powder (a toner) with a volume average particle diameter of 8 μm. The molecular weight distribution of resin components in the fine powder is shown in Table 12. This fine powder was treated by the same external addition as in Example 14 to give a negatively chargeable toner. Using the toner thus obtained, evaluation was made in the same manner as in Example 14 except that a commercially available electrophotographic copier NP-8580 (trade name; manufactured by Canon Inc.) was used as it was. Results of this evaluation are shown in Table 13.

Example 16

| | |
|---|---|
| Resin-M | 100 parts |
| Magnetic iron oxide | 80 parts |
| Low-molecular weight ethylene-propylene copolymer | 3 parts |
| Exemplary compound (4) | 1 part |
| Triphenylmethane | 2 parts |

Using the above materials, the procedure of Example 14 was repeated to give a positively chargeable fine powder (a toner) with a volume average particle diameter of 8 μm. The molecular weight distribution of resin components in the fine powder is shown in Table 12. This fine powder was treated by the same external addition as in Example 14 to give a positively chargeable toner. Using the toner thus obtained, evaluation was made in the same manner as in Example 14. Results of this evaluation are shown in Table 13.

Example 17

| | |
|---|---|
| Resin-N | 100 parts |
| Magnetic iron oxide | 80 parts |
| Low-molecular weight ethylene-propylene copolymer | 3 parts |
| Exemplary compound (5) | 2 parts |

-continued

| | |
|---|---|
| Nigrosine | 2 parts |

Using the above materials, the procedure of Example 14 was repeated to give a positively chargeable fine powder (a toner) with a volume average particle diameter of 8 μm. The molecular weight distribution of resin components in the fine powder is shown in Table 12. This fine powder was treated by the same external addition as in Example 14 to give a positively chargeable toner. Using the toner thus obtained, evaluation was made in the same manner as in Example 14. Results of this evaluation are shown in Table 13.

Example 18

| | |
|---|---|
| Resin-O | 100 parts |
| Magnetic iron oxide | 80 parts |
| Low-molecular weight ethylene-propylene copolymer | 3 parts |
| Exemplary compound (9) | 1 parts |
| Triphenylmethane | 2 parts |

Using the above materials, the procedure of Example 14 was repeated to give a positively chargeable fine powder (a toner) with a volume average particle diameter of 8 μm. The molecular weight distribution of resin components in the fine powder is shown in Table 12. This fine powder was treated by the same external addition as in Example 14 to give a positively chargeable toner. Using the toner thus obtained, evaluation was made in the same manner as in Example 14. Results of this evaluation are shown in Table 13.

Example 19

| | |
|---|---|
| Resin-P | 100 parts |
| Magnetic iron oxide | 80 parts |
| Low-molecular weight ethylene-propylene copolymer | 3 parts |
| Exemplary compound (10) | 3 parts |
| Nigrosine | 2 parts |

Using the above materials, the procedure of Example 14 was repeated to give a positively chargeable fine powder (a toner) with a volume average particle diameter of 8 μm. The molecular weight distribution of resin components in the fine powder is shown in Table 12. This fine powder was treated by the same external addition as in Example 14 to give a positively chargeable toner. Using the toner thus obtained, evaluation was made in the same manner as in Example 14. Results of this evaluation are shown in Table 13.

Example 20

| | |
|---|---|
| Resin-Q | 100 parts |
| Magnetic iron oxide | 80 parts |
| Low-molecular weight ethylene-propylene copolymer | 3 parts |
| Exemplary compound (14) | 2 parts |
| Quaternary ammonium salt | 2 parts |

Using the above materials, the procedure of Example 14 was repeated to give a positively chargeable fine powder (a toner) with a volume average particle diameter of 8 μm. The molecular weight distribution of resin components in the fine powder is shown in Table 12.

This fine powder was treated by the same external addition as in Example 14 to give a positively chargeable toner. Using the toner thus obtained, evaluation was made in the same manner as in Example 14. Results of this evaluation are shown in Table 13.

Comparative Example 7

| | |
|---|---|
| Resin-R | 100 parts |
| Magnetic iron oxide | 80 parts |
| Low-molecular weight ethylene-propylene copolymer | 3 parts |
| Exemplary compound (1) | 1 part |
| Nigrosine | 2 parts |

Using the above materials, the procedure of Example 14 was repeated to give a positively chargeable fine powder (a toner) with a volume average particle diameter of 8 μm. The molecular weight distribution of resin components in the fine powder is shown in Table 12. This fine powder was treated by the same external addition as in Example 14 to give a positively chargeable toner. Using the toner thus obtained, evaluation was made in the same manner as in Example 14. As a result, although image quality was good, anti-offset properties and toner flow-out preventive properties were inferior. Results of this evaluation are shown in Table 13.

Comparative Example 8

| | |
|---|---|
| Resin-K | 100 parts |
| Magnetic iron oxide | 80 parts |
| Low-molecular weight ethylene-propylene copolymer | 3 parts |
| Nigrosine | 2 parts |

Using the above materials, the procedure of Example 14 was repeated to give a positively chargeable fine powder (a toner) with a volume average particle diameter of 8 μm. The molecular weight distribution of resin components in the fine powder is shown in Table 12. This fine powder was treated by the same external addition as in Example 14 to give a positively chargeable toner. Using the toner thus obtained, evaluation was made in the same manner as in Example 14. As a result, although image quality was good, anti-offset properties and toner flow-out preventive properties were inferior. Results of this evaluation are shown in Table 13.

Comparative Example 9

| | |
|---|---|
| Resin-K | 100 parts |
| Magnetic iron oxide | 80 parts |
| Low-molecular weight ethylene-propylene copolymer | 3 parts |
| Acetylacetone aluminum complex | 1 part |
| Nigrosine | 2 parts |

Using the above materials, the procedure of Example 14 was repeated to give a positively chargeable fine powder (a toner) with a volume average particle diameter of 8 μm. The molecular weight distribution of resin components in the fine powder is shown in Table 12. This fine powder was treated by the same external addition as in Example 14 to give a positively chargeable toner. Using the toner thus obtained, evaluation was made in the same manner as in Example 14. As a result, although fixing performance and anti-offset properties were good, image density was poor and fogging was seen. Results of this evaluation are shown in Table 13.

Comparative Example 10

| | |
|---|---|
| Resin-K | 100 parts |
| Magnetic iron oxide | 80 parts |
| Low-molecular weight ethylene-propylene copolymer | 3 parts |
| N-hexyldecyltrimethylenediamine | 1 part |
| Nigrosine | 2 parts |

Using the above materials, the procedure of Example 14 was repeated to give a positively chargeable fine powder (a toner) with a volume average particle diameter of 8 μm. The molecular weight distribution of resin components in the fine powder is shown in Table 12. This fine powder was treated by the same external addition as in Example 14 to give a positively chargeable toner. Using the toner thus obtained, evaluation was made in the same manner as in Example 14. As a result, although fixing performance and anti-offset properties were good, image density tended to slightly decrease with repetition of copying, which was found to be due to contamination of the sleeve. Results of this evaluation are shown in Table 13.

TABLE 12

| | Molecular Weight Distribution of Resin Component in Toner | | |
|---|---|---|---|
| | $5 \times 10^3$ to $5 \times 10^4$ Peak | $\geqq 10^5$ Peak, shoulder | $\geqq 10^5$ Weight percentage (%) |
| Example: | | | |
| 14 | 9,800 | 270,000 | 20 |
| 15 | 10,500 | 230,000 | 29 |
| 16 | 12,300 | 290,000 | 32 |
| 17 | 16,700 | 240,000 | 18 |
| 18 | 11,800 | 580,000 | 17 |
| 19 | 10,300 | 430,000 | 24 |
| 20 | 7,600 | 540,000 | 45 |
| Comparative Example: | | | |
| 7 | 10,000 | 250,000 | 24 |
| 8 | 9,700 | 250,000 | 23 |
| 9 | 9,900 | 270,000 | 21 |
| 10 | 9,800 | 290,000 | 18 |

TABLE 13

| | Results of Evaluation | | | | | | |
|---|---|---|---|---|---|---|---|
| | Image quality | | | | | | |
| | Initial stage | | On 10,000 sheet | | | | |
| | Fog | Image density | Fog | Image density | (1) | (2) | (3) (%) |
| Example: | | | | | | | |
| 14 | AA | 1.30 | AA | 1.35 | A | AA | 7 |
| 15 | A | 1.35 | AA | 1.36 | AA | AA | 8 |
| 16 | A | 1.31 | AA | 1.37 | A | AA | 11 |
| 17 | A | 1.31 | A | 1.33 | B | A | 9 |
| 18 | AA | 1.33 | AA | 1.38 | A | AA | 8 |
| 19 | A | 1.34 | AA | 1.35 | AA | AA | 5 |
| 20 | A | 1.30 | A | 1.31 | A | AA | 12 |
| Comparative Example: | | | | | | | |
| 7 | A | 1.34 | AA | 1.35 | C | B | 10 |
| 8 | AA | 1.33 | AA | 1.36 | C | A | 9 |
| 9 | C | 1.16 | B | 1.12 | A | AA | 8 |
| 10 | A | 1.32 | B | 1.22 | A | AA | 9 |

(1): Toner flow-out image stain
(2): Anti-offset properties
(3): Fixing performance
AA: Excellent, A: Good, B: Passable, C: Failure Example 21

| | |
|---|---|
| Resin-S | 100 parts |
| Magnetic iron oxide | 80 parts |
| Low-molecular weight ethylene-propylene copolymer | 3 parts |
| Exemplary compound (1) | 1 part |
| Nigrosine | 2 parts |

Using the above materials, the procedure of Example 14 was repeated to give a positively chargeable fine powder (a toner) with a volume average particle diameter of 8 μm. This fine powder was treated by the same external addition as in Example 14 to give a positively chargeable toner. This toner was applied to a modified machine of a commercially available electrophotographic copier NP-8580 (trade name; manufactured by Canon Inc.), so modified as to be equipped with a negatively chargeable amorphous silicone drum to make it possible to use the positively chargeable toner, and a copying test was made. Image density after copying on 300 sheets under environmental conditions of a temperature of 23° C. and a humidity of 60% RH was 1.32, and sharp images free from fog and coarseness were obtained. Copies were further taken on 10,000 sheets to examine running performance. As a result, the image density was 1.35, showing no decrease in density, and good images free from fog and coarseness and well comparable to the initial images were obtained. Results obtained here are shown in Table 14.

Next, a copying test was made under environmental conditions of a temperature of 15° C. and a humidity of 10% RH. As a result, images with a high-density and a good image quality were similarly obtained. The same good results were also obtained in a 5,000 sheet copying test. Results obtained here are shown in Table 15.

A copying test was also made under environmental conditions of a temperature of 35° C. and a humidity of 85% RH. As a result, images with a high-density and a good image quality were similarly obtained. The same good results were also obtained in a 5,000 sheet copying test. Results obtained under these environmental conditions are shown in Table 16.

Anti-offset properties were also evaluated.

The evaluation test machine was left to stand overnight under environmental conditions of a temperature of 15° C. and a humidity of 10% RH so that the test machine and its inside fixing assembly became adapted to the low-temperature low-humidity environment. Then, in that state, copied images were continuously obtained on 200 sheets and thereafter copied images were obtained sheet by sheet for 3 minutes at intervals of 30 seconds to examine whether or not any image stain occurred. As a result, even no offset occurred. Moreover, no toner flowed out of a cleaning member of the fixing assembly. Results of these are shown in Table 17.

Example 22

| | |
|---|---|
| Resin-T | 100 parts |
| Magnetic iron oxide | 80 parts |
| Low-molecular weight ethylene-propylene copolymer | 3 parts |
| Exemplary compound (1) | 1 part |
| Nigrosine | 2 parts |

Using the above materials, the procedure of Example 14 was repeated to give a positively chargeable fine powder (a toner) with a volume average particle diameter of 8 μm. This fine powder was treated by the same external addition as in Example 14 to give a positively chargeable toner. Using the toner thus obtained, evaluation was made in the same manner as in Example 21. Results of this evaluation are shown in Tables 14 to 17.

TABLE 14

| | Image Evaluation under 23° C./60% RH | | | | |
|---|---|---|---|---|---|
| | Binder resin | Initial stage | | On 10,000th sheet | |
| | | Image density | Fog | Image density | Fog |
| Example: | | | | | |
| 21 | Resin-S | 1.32 | AA | 1.35 | AA |
| 22 | Resin-T | 1.30 | A | 1.32 | A |

AA: Excellent, A: Good, B: Passable, C: Failure

TABLE 15

| | Image Evaluation under 15° C./10% RH | | | | |
|---|---|---|---|---|---|
| | Binder resin | Initial stage | | On 5,000th sheet | |
| | | Image density | Fog | Image density | Fog |
| Example: | | | | | |
| 21 | Resin-S | 1.36 | A | 1.38 | A |
| 22 | Resin-T | 1.34 | A | 1.35 | A |

AA: Excellent, A: Good, B: Passable, C: Failure

TABLE 16

| | Image Evaluation under 32.5° C./85% RH | | | | |
|---|---|---|---|---|---|
| | Binder resin | Initial stage | | On 5,000th sheet | |
| | | Image density | Fog | Image density | Fog |
| Example: | | | | | |
| 21 | Resin-S | 1.30 | A | 1.34 | AA |
| 22 | Resin-T | 1.30 | A | 1.30 | A |

AA: Excellent
A: Good
B: Passable
C: Failure

TABLE 17

| | Anti-offset properties |
|---|---|
| Example 21 | AA |
| Example 22 | B |

AA: Excellent
A: Good
B: Passable
C: Failure

Example 23

| | |
|---|---|
| Resin-K | 100 parts |
| Magnetic iron oxide | 80 parts |
| Low-molecular weight ethylene-propylene copolymer | 3 parts |
| Exemplary compound (27) | 1 part |
| Nigrosine | 2 parts |

The above materials were premixed and thereafter melt-kneaded using a twin-screw extruder set to 130° C. The kneaded product obtained was cooled and then crushed. Thereafter the crushed product was finely pulverized by means of a grinding mill making use of a jet stream. Subsequently, the finely pulverized powder obtained was classified using an air classifier to give a positively chargeable fine powder (a toner) with a volume average particle diameter of 8 μm.

Molecular weight distribution was measured by GPC using a high-speed liquid chromatograph 150C, available from Waters Co. Columns used were comprised of a combination of Shodex GPC KF-801, KF-802, KF- 803, KF-804, KF-805, KF-806, KF-807 and KF-800P, available from Showa Denko K.K. The sample was so prepared as to have resin components in a concentration of 5 mg/ml. Molecular weight distribution of the resin components in this fine powder is shown in Table 18, in which only the largest peak value is set out.

To 100 parts of the fine powder thus obtained, 0.6 part of hydrophobic colloidal silica was externally added to give a positively chargeable toner. This toner was applied to a modified machine of a commercially available electrophotographic copier NP-8580 (trade name; manufactured by Canon Inc.), so modified as to be equipped with a negatively chargeable amorphous silicone drum to make it possible to use the positively chargeable toner. Using this copier, fixing performance, toner flow-out preventive properties, image quality and durability (or running performance) were evaluated. Results of this copying test are shown in Table 19. Throughout the copying test, fog-free images were obtained with an always stable high density (1.33 to 1.36). Images were also confirmed to be faithful to an original, as having excellent halftone reproduction and line reproduction. Images fixed using a fixing assembly controlled to be set at a temperature of 160° C. were used to evaluate the fixing performance. To evaluate the fixing performance, the images were rubbed 10 times with Silbon paper under application of a load of about 100 g to examine wear-off of images, and its degree was indicated as percentage (%) of decrease in reflection density. To evaluate the toner flow-out preventive properties, copied images were continuously obtained on 200 sheets and thereafter copied images were obtained sheet by sheet for 3 minutes at intervals of 30 seconds to examine whether or not any image stain occurred. The fixing performance was found good and also no offset occurred. There also was seen no toner flowing out of a cleaning member of the fixing assembly.

Example 24

| | |
|---|---|
| Resin-L | 100 parts |
| Magnetic iron oxide | 80 parts |
| Low-molecular weight ethylene-propylene copolymer | 3 parts |
| Exemplary compound (46) | 1 part |
| Azochromium complex | 2 parts |

Using the above materials, the procedure of Example 23 was repeated to give a negatively chargeable fine powder (a toner) with a volume average particle diameter of 8 μm. The molecular weight distribution of resin components in the fine powder is shown in Table 18. This fine powder was treated by the same external addition as in Example 23 to give a negatively chargeable toner. Using the toner thus obtained, evaluation was made in the same manner as in Example 23 except that a commercially available electrophotographic copier NP-8580 (trade name; manufactured by Canon Inc.) was used as it was. Results of this evaluation are shown in Table 19.

Example 25

| | |
|---|---|
| Resin-M | 100 parts |
| Magnetic iron oxide | 80 parts |
| Low-molecular weight ethylene-propylene copolymer | 3 parts |
| Exemplary compound (19) | 1 part |

-continued

| | |
|---|---|
| Triphenylmethane | 2 parts |

Using the above materials, the procedure of Example 23 was repeated to give a positively chargeable fine powder (a toner) with a volume average particle diameter of 8 μm. The molecular weight distribution of resin components in the fine powder is shown in Table 18. This fine powder was treated by the same external addition as in Example 23 to give a positively chargeable toner. Using the toner thus obtained, evaluation was made in the same manner as in Example 23. Results of this evaluation are shown in Table 19.

Example 26

| | |
|---|---|
| Resin-N | 100 parts |
| Magnetic iron oxide | 80 parts |
| Low-molecular weight ethylene-propylene copolymer | 3 parts |
| Exemplary compound (38) | 2 parts |
| Nigrosine | 2 parts |

Using the above materials, the procedure of Example 23 was repeated to give a positively chargeable fine powder (a toner) with a volume average particle diameter of 8 μm. The molecular weight distribution of resin components in the fine powder is shown in Table 18. This fine powder was treated by the same external addition as in Example 23 to give a positively chargeable toner. Using the toner thus obtained, evaluation was made in the same manner as in Example 23. Results of this evaluation are shown in Table 19.

Example 27

| | |
|---|---|
| Resin-O | 100 parts |
| Magnetic iron oxide | 80 parts |
| Low-molecular weight ethylene-propylene copolymer | 3 parts |
| Exemplary compound (30) | 1 part |
| Triphenylmethane | 2 parts |

Using the above materials, the procedure of Example 23 was repeated to give a positively chargeable fine powder (a toner) with a volume average particle diameter of 8 μm. The molecular weight distribution of resin components in the fine powder is shown in Table 18. This fine powder was treated by the same external addition as in Example 23 to give a positively chargeable toner. Using the toner thus obtained, evaluation was made in the same manner as in Example 23. Results of this evaluation are shown in Table 19.

Example 28

| | |
|---|---|
| Resin-P | 100 parts |
| Magnetic iron oxide | 80 parts |
| Low-molecular weight ethylene-propylene copolymer | 3 parts |
| Exemplary compound (40) | 3 parts |
| Nigrosine | 2 parts |

Using the above materials, the procedure of Example 23 was repeated to give a positively chargeable fine powder (a toner) with a volume average particle diameter of 8 μm. The molecular weight distribution of resin components in the fine powder is shown in Table 18. This fine powder was treated by the same external addition as in Example 23 to give a positively chargeable toner. Using the toner thus obtained, evaluation was made in the same manner as in Example 23. Results of this evaluation are shown in Table 19.

Example 29

| | |
|---|---|
| Resin-Q | 100 parts |
| Magnetic iron oxide | 80 parts |
| Low-molecular weight ethylene-propylene copolymer | 3 parts |
| Exemplary compound (57) | 2 parts |
| Quaternary ammonium salt | 2 parts |

Using the above materials, the procedure of Example 23 was repeated to give a positively chargeable fine powder (a toner) with a volume average particle diameter of 8 μm. The molecular weight distribution of resin components in the fine powder is shown in Table 18. This fine powder was treated by the same external addition as in Example 23 to give a positively chargeable toner. Using the toner thus obtained, evaluation was made in the same manner as in Example 23. Results of this evaluation are shown in Table 19.

Comparative Example 11

| | |
|---|---|
| Resin-R | 100 parts |
| Magnetic iron oxide | 80 parts |
| Low-molecular weight ethylene-propylene copolymer | 3 parts |
| Exemplary compound (27) | 1 part |
| Nigrosine | 2 parts |

Using the above materials, the procedure of Example 23 was repeated to give a positively chargeable fine powder (a toner) with a volume average particle diameter of 8 μm. The molecular weight distribution of resin components in the fine powder is shown in Table 18. This fine powder was treated by the same external addition as in Example 23 to give a positively chargeable toner. Using the toner thus obtained, evaluation was made in the same manner as in Example 23. As a result, although image quality was good, anti-offset properties and toner flow-out preventive properties were inferior. Results of this evaluation are shown in Table 19.

Comparative Example 12

| | |
|---|---|
| Resin-K | 100 parts |
| Magnetic iron oxide | 80 parts |
| Low-molecular weight ethylene-propylene copolymer | 3 parts |
| Nigrosine | 2 parts |

Using the above materials, the procedure of Example 23 was repeated to give a positively chargeable fine powder (a toner) with a volume average particle diameter of 8 μm. The molecular weight distribution of resin components in the fine powder is shown in Table 18. This fine powder was treated by the same external addition as in Example 23 to give a positively chargeable toner. Using the toner thus obtained, evaluation was made in the same manner as in Example 23. As a result, although image quality was good, anti-offset properties and toner flow-out preventive properties were inferior. Results of this evaluation are shown in Table 19.

Comparative Example 13

| | |
|---|---|
| Resin-K | 100 parts |
| Magnetic iron oxide | 80 parts |

-continued

| | |
|---|---|
| Low-molecular weight ethylene-propylene copolymer | 3 parts |
| Acetylacetone aluminum complex | 1 part |
| Nigrosine | 2 parts |

Using the above materials, the procedure of Example 23 was repeated to give a positively chargeable fine powder (a toner) with a volume average particle diameter of 8 μm. The molecular weight distribution of resin components in the fine powder is shown in Table 18. This fine powder was treated by the same external addition as in Example 23 to give a positively chargeable toner. Using the toner thus obtained, evaluation was made in the same manner as in Example 23. As a result, although fixing performance and anti-offset properties was good, image density was poor and fogging was seen. Results of this evaluation are shown in Table 19.

TABLE 18

| | Molecular Weight Distribution of Resin Component in Toner | | |
|---|---|---|---|
| | $5 \times 10^3$ to $5 \times 10^4$ Peak | $\geqq 10^5$ Peak, shoulder | $\geqq 10^5$ Weight percentage (%) |
| Example: | | | |
| 23 | 9,800 | 280,000 | 21 |
| 24 | 11,000 | 240,000 | 31 |
| 25 | 12,000 | 290,000 | 32 |
| 26 | 16,700 | 250,000 | 19 |
| 27 | 11,800 | 550,000 | 15 |
| 28 | 10,600 | 450,000 | 27 |
| 29 | 7,600 | 550,000 | 46 |
| Comparative Example: | | | |
| 11 | 10,000 | 250,000 | 24 |
| 12 | 9,700 | 250,000 | 23 |
| 13 | 9,900 | 270,000 | 21 |

TABLE 19

| | Results of Evaluation | | | | | | |
|---|---|---|---|---|---|---|---|
| | Image quality | | | | | | |
| | Initial stage | | On 10,000th sheet | | | | |
| | Fog | Image density | Fog | Image density | (1) | (2) | (3) (%) |
| Example: | | | | | | | |
| 23 | AA | 1.33 | AA | 1.36 | AA | AA | 7 |
| 24 | A | 1.34 | AA | 1.35 | AA | AA | 9 |
| 25 | A | 1.32 | AA | 1.34 | A | AA | 10 |
| 26 | A | 1.33 | A | 1.35 | B | A | 9 |
| 27 | AA | 1.33 | AA | 1.35 | A | A | 8 |
| 28 | A | 1.32 | AA | 1.36 | AA | AA | 8 |
| 29 | A | 1.30 | A | 1.30 | A | AA | 13 |
| Comparative Example: | | | | | | | |
| 11 | A | 1.34 | AA | 1.36 | c | B | 10 |
| 12 | AA | 1.33 | AA | 1.36 | c | A | 9 |
| 13 | C | 1.16 | B | 1.12 | A | AA | 8 |

(1): Toner flow-out image stain
(2): Anti-offset properties
(3): Fixing performance
AA: Excellent, A: Good, B: Passable, C: Failure Example 30

| | |
|---|---|
| Resin-S | 100 parts |
| Magnetic iron oxide | 80 parts |
| Low-molecular weight ethylene-propylene copolymer | 3 parts |
| Exemplary compound (27) | 1 part |

-continued

| | |
|---|---|
| Nigrosine | 2 parts |

Using the above materials, the procedure of Example 23 was repeated to give a positively chargeable fine powder (a toner) with a volume average particle diameter of 8 μm. This fine powder was treated by the same external addition as in Example 23 to give a positively chargeable toner. This toner was applied to a modified machine of a commercially available electrophotographic copier NP-8580 (trade name; manufactured by Canon Inc.), so modified as to be equipped with a negatively chargeable amorphous silicone drum to make it possible to use the positively chargeable toner, and a copying test was made. Image density after copying on 300 sheets under environmental conditions of a temperature of 23° C. and a humidity of 60% RH was 1.32, and sharp images free from fog and coarseness were obtained. Copies were further taken on 10,000 sheets to examine running performance. As a result, the image density was 1.35, showing no decrease in density, and good images free from fog and coarseness and well comparable to the initial images were obtained. Results obtained here are shown in Table 20.

Next, a copying test was made under environmental conditions of a temperature of 15° C. and a humidity of 10% RH. As a result, images with a high-density and a good image quality were similarly obtained. The same good results were also obtained in a 5,000 sheet copying test. Results obtained here are shown in Table 21.

A copying test was also made under environmental conditions of a temperature of 35° C. and a humidity of 85% RH. As a result, images with a high-density and a good image quality were similarly obtained. The same good results were also obtained in a 5,000 sheet copying test. Results obtained under these environmental conditions are shown in Table 22.

Anti-offset properties were also evaluated.

The evaluation test machine was left to stand overnight under environmental conditions of a temperature of 15° C. and a humidity of 10% RH so that the test machine and its inside fixing assembly became adapted to the low-temperature low-humidity environment. Then, in that state, copied images were continuously obtained on 200 sheets and thereafter copied images were obtained sheet by sheet for 3 minutes at intervals of 30 seconds to examine whether or not any image stain occurred. As a result, even no offset occurred. Moreover, no toner flowed out of a cleaning member of the fixing assembly. Results of these are shown in Table 23.

Example 31

| | |
|---|---|
| Resin-T | 100 parts |
| Magnetic iron oxide | 80 parts |
| Low-molecular weight ethylene-propylene copolymer | 3 parts |
| Exemplary compound (27) | 1 part |
| Nigrogine | 2 parts |

Using the above materials, the procedure of Example 23 was repeated to give a positively chargeable fine powder (a toner) with a volume average particle diameter of 8 μm. This fine powder was treated by the same external addition as in Example 23 to give a positively chargeable toner. Using the toner thus obtained, evaluation was made in the same manner as in Example 30.

Results of this evaluation are shown in Tables 20 to 23.

TABLE 20

| | Image Evaluation under 23° C./60% RH | | | | |
|---|---|---|---|---|---|
| | Binder resin | Initial stage | | On 10,000th sheet | |
| | | Image density | Fog | Image density | Fog |
| Example: | | | | | |
| 30 | Resin-S | 1.32 | AA | 1.35 | AA |
| 31 | Resin-T | 1.30 | A | 1.32 | A |

AA: Excellent, A: Good, B: Passable, C: Failure

TABLE 21

| | Image Evaluation under 15° C./10% RH | | | | |
|---|---|---|---|---|---|
| | Binder resin | Initial stage | | On 10,000th sheet | |
| | | Image density | Fog | Image density | Fog |
| Example: | | | | | |
| 30 | Resin-S | 1.35 | A | 1.37 | A |
| 31 | Resin-T | 1.33 | A | 1.34 | A |

AA: Excellent, A: Good, B: Passable, C: Failure

TABLE 22

| | Image Evaluation under 32.5° C./85% RH | | | | |
|---|---|---|---|---|---|
| | Binder resin | Initial stage | | On 10,000th sheet | |
| | | Image density | Fog | Image density | Fog |
| Example: | | | | | |
| 30 | Resin-S | 1.29 | A | 1.33 | AA |
| 31 | Resin-T | 1.30 | A | 1.30 | A |

AA: Excellent, A: Good, B: Passable, C: Failure

TABLE 23

| | Anti-offset properties |
|---|---|
| Example 30 | AA |
| Example 31 | B |

AA: Excellent
B: Passable
C: Failure

What is claimed is:

1. A toner for developing electrostatic images comprising: toner particles, wherein each of said toner particles contains a binder resin having as a constituent an acid component with an acid value of from 0.5 mg.KOH/g to 100 mg.KOH/g, a colorant, and at least one of the compounds represented by the following Formulas (I), (II) and (III):

Formula (I)

$$R_1HN\text{-}Ar\text{-}NHR_2$$

wherein Ar represents a substituted or unsubstituted aryl group; and $R_1$ and $R_2$ are the same or different and each represent a hydrogen atom, an alkyl group or a phenyl group which is substituted or unsubstituted, and a nitrogen-containing ring structure formed by combining at least one of them with Ar or a nitrogen-containing ring structure formed by combining both of them with each other; and

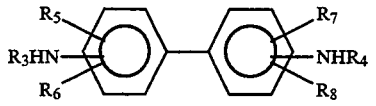

Formula (II)

where $R_3$ and $R_4$ are the same or different and each represent a hydrogen atom, an alkyl group or a phenyl group which is substituted or unsubstituted; and $R_5$, $R_6$, $R_7$ and $R_8$ are the same or different and each represent a hydrogen atom, an alkyl group, a hydroxyl group, an alkoxy group, a mercapto group, an alkylthio group, an amino group, an alkylamino group, a dialkylamino group, a halogen atom, a phenyl group which is substituted or unsubstituted, an alkenyl group, a nitrogen-containing ring structure formed by combining $R_5$ and $R_6$ with each other and a nitrogen-containing ring structure formed by combining $R_7$ and $R_8$ with each other;

Formula (III)

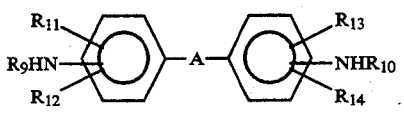

wherein A represents a linking group, $R_9$ and $R_{10}$ are the same or different and each represent a hydrogen atom, an alkyl group or a phenyl group, which is substituted or unsubstituted; and $R_{11}$, $R_{12}$, $R_{13}$ and $R_{14}$ are the same or different and each represent a hydrogen atom, an alkyl group, a hydroxyl group, an alkoxy group, a mercapto group, an alkylthio group, an amino group, an alkyl amino group, a dialkylamino group, a halogen atom, a phenyl group which is substituted or unsubstituted an alkenyl group, a nitrogen-containing ring structure formed by combining $R_{11}$ and $R_{12}$ with each other, and a nitrogen-containing ring structure formed by combining $R_{13}$ and $R_{14}$ with each other.

2. The toner according to claim 1, which comprises a binder resin having at least a peak in the region of a molecular weight of from $5\times10^3$ to $5\times10^4$ and a peak or shoulder in the region of a molecular weight of not less than $10^5$, in the molecular weight distribution measured by gel permeation chromatography of resin components, and containing a resin component with the molecular weight of not less than $10^5$ in an amount of from 5% by weight to 50% by weight.

3. The toner according to claim 1, wherein said compound is a compound represented by the following Formula (I):

Formula (I)

$R_1HN\text{-}Ar\text{-}NHR_2$ wherein Ar represents a substituted or unsubstituted aryl group; and $R_1$ and $R_2$ are the same or different and each represent a hydrogen atom, an alkyl group or a phenyl group which is substituted or unsubstituted, and a nitrogen-containing ring structure formed by combining at least one of them with Ar or a nitrogen-containing ring structure formed by combining both of them with each other.

4. The toner according to claim 1, wherein said compound comprises at least one of a compound represented by the following Formulas (II) and (III):

Formula (II)

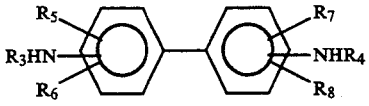

wherein $R_3$ and $R_4$ are the same or different and each represent a hydrogen atom, an alkyl group having 1 to 12 carbon atoms or a phenyl group which is substituted with a group having 0 to 6 carbon atoms; and $R_5$, $R_6$, $R_7$ and $R_8$ are the same or different and each represent a hydrogen atom, an alkyl group having 1 to 6 carbon atoms, a hydroxyl group, an alkoxy group having 1 to 6 carbon atoms, a mercapto group, an alkylthio group having 1 to 6 carbon atoms, an amino group, an alkylamino group having 1 to 6 carbon atoms, a dialkylamino group, a halogen atom, a phenyl group which is substituted with a group having 0 to 6 carbon atoms, an alkenyl group having 2 to 6 carbon atoms, a nitrogen-containing ring structure formed by combining $R_5$ and $R_6$ with each other; and a nitrogen-containing ring structure formed by combining $R_7$ and $R_8$ with each other;

Formula (III)

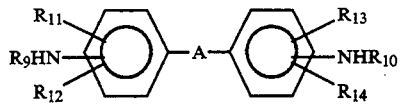

wherein A represents a linking group; $R_9$ and $R_{10}$ are the same or different and each represent a hydrogen atom, an alkyl group having 1 to 12 carbon atoms or a phenyl group which is substituted with a group having 0 to 6 carbon atoms; and $R_{11}$, $R_{12}$, $R_{13}$ and $R_{14}$ are the same or different and each represent a hydrogen atom, an alkyl group having 1 to 6 carbon atoms, a hydroxyl group, an alkoxy group having 1 to 6 carbon atoms, a mercapto group, an alkylthio group having 1 to 6 carbon atoms, an amino group, an alkylamino group having 1 to 6 carbon atoms, a dialkylamino group, a halogen atom, a phenyl group which is substituted with a group having 0 to 6 carbon atoms, an alkenyl group having 2 to 6 carbon atoms, a nitrogen-containing ring structure formed by combining $R_{11}$ and $R_{12}$ with each other, and a nitrogen-containing ring structure formed by combining $R_{13}$ and $R_{14}$ with each other.

5. The toner according to claim 1, wherein said compound is a compound represented by the following Formula (I);

Formula (I)

$R_1HN\text{-}Ar\text{-}NHR_2$ wherein Ar represents a substituted or unsubstituted aryl group; and $R_1$ and $R_2$ are the same or different and each represent a hydrogen atom, an alkyl group or a phenyl group which is substituted or unsubstituted, and a nitrogen-containing ring structure formed by combining at least one of them with Ar or a nitrogen-containing ring structure formed by combining both of them with each other; and said toner comprises a binder resin having at least a peak in the region of a molecular weight of from $5\times10^3$ to $5\times10^4$ and a peak or shoulder in the region of a molecular weight of not less than $10^5$, in the molecular weight distribution measured by gel permeation chromatography of resin components, and containing a resin component with the molecular weight of not less than $10^5$ in an amount of from 5% by weight to 50% by weight.

6. The toner according to claim 1, wherein said component comprises at least one of compounds represented by the following Formulas (II) and (III);

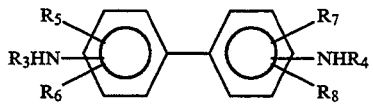

Formula (II)

where $R_3$ and $R_4$ are the same or different and each represent a hydrogen atom, an alkyl group having 1 to 12 carbon atoms or a phenyl group which is substituted with a group having 0 to 6 carbon atoms; and $R_5$, $R_6$, $R_7$ and $R_8$ are the same or different and each represent a hydrogen atom, an alkyl group having 1 to 6 carbon atoms, a hydroxyl group, an alkoxy group having 1 to 6 carbon atoms, a mercapto group, an alkylthio group having 1 to 6 carbon atoms, an amino group, an alkylamino group having 1 to 6 carbon atoms, a dialkylamino group, a halogen atom, a phenyl group which is substituted with a group having 0 to 6 carbon atoms, an alkenyl group having 2 to 6 carbon atoms, a nitrogen-containing ring structure formed by combining $R_5$ and $R_6$ with each other, and a nitrogen-containing ring structure formed by combining $R_7$ and $R_8$ with each other;

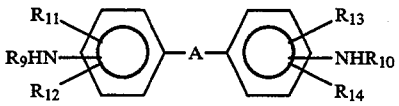

Formula (III)

wherein A represents a linking group; $R_9$ and $R_{10}$ are the same or different and each represent a hydrogen atom, an alkyl group having 1 to 12 carbon atoms or a phenyl group which is substituted with a group having 0 to 6 carbon atoms; and $R_{11}$, $R_{12}$, $R_{13}$ and $R_{14}$ are the same or different and each represent a hydrogen atom, an alkyl group having 1 to 6 carbon atoms, a hydroxyl group, an alkoxy group having 1 to 6 carbon atoms, a mercapto group, an alkylthio group having 1 to 6 carbon atoms, an amino group, an alkylamino group having 1 to 6 carbon atoms, a dialkylamino group, a halogen atom, a phenyl group which is substituted with a group having 0 to 6 carbon atoms, an alkenyl group having 2 to 6 carbon atoms, a nitrogen-containing ring structure formed by combining $R_{11}$ and $R_{12}$ with each other and a nitrogen-containing ring structure formed by combining $R_{13}$ and $R_{14}$ with each other; and said toner comprises a binder resin having at least a peak in the region of a molecular weight of from $5\times10^3$ to $5\times10^4$ and a peak or shoulder in the region of a molecular weight of not less than $10^5$, in the molecular weight distribution measured by gel permeation chromatography of resin components, and containing a resin component with the molecular weight of not less than $10^5$ in an amount of from 5% by weight to 50% by weight.

7. The toner according to claim 1, wherein said binder resin comprises an acid anhydride.

8. The toner according to claim 1, wherein said binder resin has an acid component with an acid value of from 0.5 mg.KOH/g to 100 mg.KOH/g, ascribable to an acid anhydride.

9. The toner according to claim 1, wherein said at least one of compounds represented by Formulas (I), (II) and (III) is contained in an amount of from 0.01 part by weight to 10 parts by weight based on 100 parts by weight of said binder resin.

10. The toner according to claim 1, wherein said binder resin comprises a vinyl type copolymer or a polyester resin.

11. The toner according to claim 10, wherein said vinyl type copolymer is obtained by polymerizing a monomer composition containing a monomer having a carboxyl group or an acid anhydride group which is a derivative of a carboxyl group.

12. The toner according to claim 11, wherein said monomer composition contains a monoester of an $\alpha,\beta$-unsaturated dibasic acid.

13. The toner according to claim 10, wherein said vinyl type copolymer comprises a styrene-acrylic copolymer.

14. The toner according to claim 10, wherein said vinyl type copolymer comprises a cross-linked vinyl type copolymer.

15. The toner according to claim 14, wherein said cross-linked vinyl type copolymer is obtained by using a cross-linking monomer in an amount of from 0.01 part by weight to 5 parts by weight based on 100 parts by weight of other monomers.

16. The toner according to claim 10, wherein said polyester resin is obtained by condensation polymerization of a dibasic acid component and a dihydric alcohol component.

17. The toner according to claim 10, wherein said polyester resin comprises a cross-linked polyester resin.

18. The toner according to claim 17, wherein said cross-linked polyester resin is obtained by using at least one of a tribasic or higher acid component and a trihydric or higher alcohol component in an amount of from 5 mol % to 60 mol % on the basis of the whole alcohol component and acid component.

19. The toner according to claim 1, which comprises a positively chargeable toner having a positive charge control agent.

20. The toner according to claim 1, which comprises a negatively chargeable toner having a negative charge control agent.

21. An image forming apparatus comprising;

an electrostatic image bearing member which bears an electrostatic image on its surface;

a charging means for electrostatically charging said electrostatic image bearing member;

a developing means for developing the electrostatic image carried on said electrostatic image bearing member;

a transfer means for transferring the toner image formed by said developing means to a recording medium;

a cleaning means for removing deposits on said electrostatic image bearing member; and a fixing means for fixing the toner image transferred to said recording medium, by the action of heat and pressure;

wherein said developing means comprises a toner for developing electrostatic images, comprising toner particles, each of which contains a binder resin having as a constituent an acid component with an acid value of from 0.5 to 100 mg.KOH/g, a colorant, and at least one of compounds represented by the following Formulas (I), (II) and (III):

Formula (I)

$R_1HN\text{-}Ar\text{-}NHR_2$ wherein Ar represents a substituted or unsubstituted aryl group; and $R_1$ and $R_2$ are the same or different and each represent a hydrogen atom, an alkyl group or a phenyl group which is substituted or unsubstituted, and a nitrogen-containing ring structure formed by combining at least one of them with Ar or a nitrogen-containing ring structure formed by combining both of them with each other; and Formula (II)

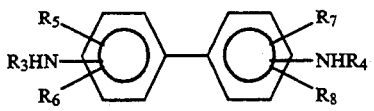

where $R_3$ and $R_4$ are the same or different and each represent a hydrogen atom, an alkyl group or a phenyl group which is substituted or unsubstituted; and $R_5$, $R_6$, $R_7$ and $R_8$ are the same or different and each represent a hydrogen atom, an alkyl group, a hydroxyl group, an alkoxy group, a mercapto group, an alkylthio group, an amino group, an alkylamino group, a dialkylamino group, a halogen atom, a phenyl group which is substituted or unsubstituted, an alkenyl group, a nitrogen-containing ring structure formed by combining $R_5$ and $R_6$ with each other and a nitrogen-containing ring structure formed by combining $R_7$ and $R_8$ with each other;

Formula (III)

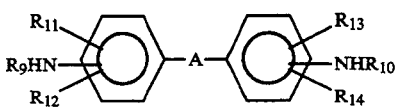

wherein A represents a linking group, $R_9$ and $R_{10}$ are the same or different and each represent a hydrogen atom, an alkyl group or a phenyl group, which is substituted or unsubstituted; and $R_{11}$, $R_{12}$, $R_{13}$ and $R_{14}$ are the same or different and each represent a hydrogen atom, an alkyl group, a hydroxyl group, an alkoxy group, a mercapto group, an alkylthio group, an amino group, an alkyl amino group, a dialkylamino group, a halogen atom, a phenyl group which is substituted or unsubstituted, an alkenyl group, a nitrogen-containing ring structure formed by combining $R_{11}$ and $R_{12}$ with each other, and a nitrogen-containing ring structure formed by combining $R_{13}$ and $R_{14}$ with each other.

22. The image forming apparatus according to claim 21 in which the binder resin has at least a peak in the region of a molecular weight of from $5\times10^3$ to $5\times10^4$ and a peak or shoulder in the region of a molecular weight of not less than $10^5$, in the molecular weight distribution measured by gel permeation chromatography of resin components, and containing a resin component with the molecular weight of not less than $10^5$ in an amount of from 5% by weight to 50% by weight.

23. The image forming apparatus according to claim 21, wherein said compound is a compound represented by the following Formula (I):

Formula (I)

$R_1HN\text{-}Ar\text{-}NHR_2$ ps wherein Ar represents a substituted or unsubstituted aryl group and $R_1$ and $R_2$ are the same or different and each represent a hydrogen atom, an alkyl group or a phenyl group which is substituted or unsubstituted and a nitrogen-containing ring structure formed by combining at least one of them with Ar or a nitrogen-containing ring structure formed by combining both of them with each other.

24. The image forming apparatus according to claim 21, wherein said compound comprises at least one of a compound represented by the following Formulas (II) and (III):

Formula (II)

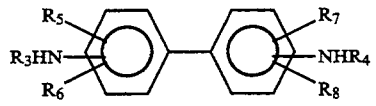

wherein $R_3$ and $R_4$ are the same or different and each represent a hydrogen atom, an alkyl group having 1 to 12 carbon atoms or a phenyl group which is substituted with a group having 0 to 6 carbon atoms; and $R_5$, $R_6$, $R_7$ and $R_8$ are the same or different and each represent a hydrogen atom, an alkyl group having 1 to 6 carbon atoms, a hydroxyl group, an alkoxy group having 1 to 6 carbon atoms, a mercapto group, an alkylthio group having 1 to 6 carbon atoms, an amino group, an alkylamino group having 1 to 6 carbon atoms, a dialkylamino group, a halogen atom, a phenyl group which is substituted with a group having 0 to 6 carbon atoms, an alkenyl group having 2 to 6 carbon atoms, a nitrogen-containing ring structure formed by combining $R_5$ and $R_6$ with each other; and a nitrogen-containing ring structure formed by combining $R_7$ and $R_8$ with each other;

Formula (III)

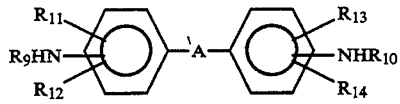

wherein A represents a linking group; $R_9$ and $R_{10}$ are the same or different and each represent a hydrogen atom, an alkyl group having 1 to 12 carbon atoms or a phenyl group which is substituted with a group having 0 to 6 carbon atoms; and $R_{11}$, $R_{12}$, $R_{13}$ and $R_{14}$ are the same or different and each represent a hydrogen atom, an alkyl group having 1 to 6 carbon atoms, a hydroxyl group, an alkoxy group having 1 to 6 carbon atoms, a mercapto group, an alkylthio group having 1 to 6 carbon atoms, an amino group, an alkylamino group having 1 to 6 carbon atoms, a dialkylamino group, a halogen atom, a phenyl group which is substituted with a group having 0 to 6 carbon atoms, an alkenyl group having 2 to 6 carbon atoms, a nitrogen-containing ring structure formed by combining $R_{11}$ and $R_{12}$ with each other and a nitrogen-containing ring structure formed by combining $R_{13}$ and $R_{14}$ with each other.

25. The image forming apparatus according to claim 21, wherein said compound is a compound represented by the following Formula (I);

Formula (I)

$R_1HN\text{-}Ar\text{-}NHR_2$ wherein Ar represents a substituted or unsubstituted aryl group and $R_1$ and $R_2$ are the same or different and each represent a hydrogen atom, an alkyl group or a phenyl group which is substituted or unsubstituted, and a nitrogen-containing ring structure formed by combining at least one of them with Ar or a nitrogen-containing ring structure formed by combining both of them with each other; and said toner comprises a binder resin having at least a peak in the region of a molecular weight of from $5\times10^3$ to $5\times10^4$ and a peak or shoulder in the region of a molecular weight of not less than $10^5$, in the molecular weight distribution measured by gel permeation chromatography of resin components, and containing a resin component with the molecular weight of not less than $10^5$ in an amount of from 5% by weight to 50% by weight.

26. The image forming apparatus according to claim 21, wherein said component comprises at least one of compounds represented by the following Formulas (II) and (III);

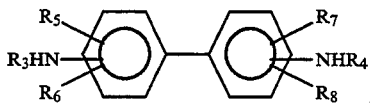

Formula (II)

where $R_3$ and $R_4$ are the same or different and each represent a hydrogen atom, an alkyl group having 1 to 12 carbon atoms or a phenyl group which is substituted with a group having 0 to 6 carbon atoms; and $R_5$, $R_6$, $R_7$ and $R_8$ are the same or different and each represent a hydrogen atom, an alkyl group having 1 to 6 carbon atoms, a hydroxyl group, an alkoxy group having 1 to 6 carbon atoms, a mercapto group, an alkylthio group having 1 to 6 carbon atoms, an amino group, an alkylamino group having 1 to 6 carbon atoms, a dialkylamino group, a halogen atom, a phenyl group which is substituted with a group having 0 to 6 carbon atoms, an alkenyl group having 2 to 6 carbon atoms, a nitrogen-containing ring structure formed by combining $R_5$ and $R_6$ with each other, and a nitrogen-containing ring structure formed by combining $R_7$ and $R_8$ with each other;

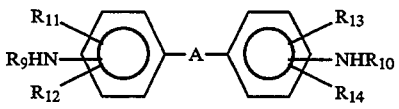

Formula (III)

wherein A represents a linking group; $R_9$ and $R_{10}$ are the same or different and each represent a hydrogen atom, an alkyl group having 1 to 12 carbon atoms or a phenyl group which is substituted with a group having 0 to 6 carbon atoms; and $R_{11}$, $R_{12}$, $R_{13}$ and $R_{14}$ are the same or different and each represent a hydrogen atom, an alkyl group having 1 to 6 carbon atoms, a hydroxyl group, an alkoxy group having 1 to 6 carbon atoms, a mercapto group, an alkylthio group having 1 to 6 carbon atoms, an amino group, an alkylamino group having 1 to 6 carbon atoms, a dialkylamino group, a halogen atom, a phenyl group which is substituted with a group having 0 to 6 carbon atoms, an alkenyl group having 2 to 6 carbon atoms, a nitrogen-containing ring structure formed by combining $R_{11}$ and $R_{12}$ with each other and a nitrogen-containing ring structure formed formed by combining $R_{13}$ and $R_{14}$ with each other; and said toner comprises a binder resin having at least a peak in the region of a molecular weight of from $5\times10^3$ to $5\times10^4$ and a peak or shoulder in the region of a molecular weight of not less than $10^5$, in the molecular weight distribution measured by gel permeation chromatography of resin components, and containing a resin component with the molecular weight of not less than $10^5$ in an amount of from 5% by weight to 50% by weight.

27. The image forming apparatus according to claim 21, wherein said binder resin comprises an acid anhydride.

28. The image forming apparatus according to claim 21, wherein said binder resin has an acid component with an acid value of from 0.5 mg.KOH/g to 100 mg.KOH/g, ascribable to an acid anhydride.

29. The image forming apparatus according to claim 21, wherein said at least one of compounds represented by Formula (I), (II) and (III) is contained in an amount of from 0.01 part by weight to 10 parts by weight based on 100 parts by weight of said binder resin.

30. The image forming apparatus according to claim 21, wherein said binder resin comprises a vinyl type copolymer or a polyester resin.

31. The image forming apparatus according to claim 30, wherein said vinyl type copolymer is obtained by polymerizing a monomer composition containing a monomer having a carboxyl group or an acid anhydride group which is a derivative of a carboxyl group.

32. The image forming apparatus according to claim 31, wherein said monomer composition contains a monomer of an $\alpha,\beta$-unsaturated dibasic acid.

33. The image forming apparatus according to claim 30, wherein said vinyl type copolymer comprises a styrene-acrylic copolymer.

34. The image forming apparatus according to claim 30, wherein said vinyl type copolymer comprises a cross-linked vinyl type copolymer.

35. The image forming apparatus according to claim 30, wherein said cross-linked vinyl type copolymer is obtained by using a cross-linking monomer in an amount of from 0.01 part by weight to 5 parts by weight based on 100 parts by weight of other monomers.

36. The image forming apparatus according to claim 30, wherein said polyester resin is obtained by condensation polymerization of a dibasic acid component and a dihydric alcohol component.

37. The image forming apparatus according to claim 30, wherein said polyester resin comprises a cross-linked polyester resin.

38. The image forming apparatus according to claim 37, wherein said cross-linked polyester resin is obtained by using at least one of a tribasic or higher acid component and a trihydric or higher alcohol component in an amount of from 5 mol % to 60 mol % on the basis of the whole alcohol component and acid component.

39. The image forming apparatus according to claim 21, which comprises a positively chargeable toner having a positive charge control agent.

40. The image forming apparatus according to claim 21, which comprises a negatively chargeable toner having a negative charge control agent.

* * * * *

UNITED STATES PATENT AND TRADEMARK OFFICE

CERTIFICATE OF CORRECTION

PATENT NO. : 5,389,484

DATED : February 14, 1995

INVENTOR(S) : KAZUYOSHI HAGIWARA, ET AL.

It is certified that error appears in the above-identified patent and that said Letters Patent is hereby corrected as shown below:

COLUMN 1

Line 10, "invention" should read --Invention--.
Line 14, "relates" should read --relates to--.
Line 26, "paper" should read --paper,--.

COLUMN 2

Line 56, "cause" should read --causes--.

COLUMN 3

Line 14, "chargeability" should read --chargeability,--.
Line 42, "matters," should read --material,--.

COLUMN 4

Line 28, "comprising;" should read --comprising:--.

COLUMN 5

Line 23, "comprising;" should read --comprising:--.

COLUMN 6

Line 32, "comprising;" should read --comprising:--.

COLUMN 7

Line 53, "comprising;" should read --comprising:--.

UNITED STATES PATENT AND TRADEMARK OFFICE

CERTIFICATE OF CORRECTION

PATENT NO. : 5,389,484

DATED : February 14, 1995

INVENTOR(S) : KAZUYOSHI HAGIWARA, ET AL.

It is certified that error appears in the above-identified patent and that said Letters Patent is hereby corrected as shown below:

COLUMN 9

Line 4, "PREFERRED" should read --THE PREFERRED--.
Line 56, "the the" should read --the--.

COLUMN 10

Line 25, "resign" should read --resin--.

COLUMN 11

Line 27, "less" should read --lest,--.
Line 28, "independent" should read --independent of--.

COLUMN 12

Line 17, "combine" should read --combine with--.
Line 18, "combine" should read --combine with--.

COLUMN 14

Line 16, "alkylthio" should read --an alkylthio--.
Line 23, "new" should read --now--.

COLUMN 23

Formula (63), " $\overset{O}{\overset{\|}{C}}$ " should read -- $\overset{S}{\overset{\|}{C}}$ --.

UNITED STATES PATENT AND TRADEMARK OFFICE

CERTIFICATE OF CORRECTION

PATENT NO. : 5,389,484

DATED : February 14, 1995

INVENTOR(S) : KAZUYOSHI HAGIWARA, ET AL.

It is certified that error appears in the above-identified patent and that said Letters Patent is hereby corrected as shown below:

COLUMN 25

Line 43, "styrene/acrylontirle" should read --styrene/acrylonitrile--.
Line 53, "tarpane" should read --terpene--.

COLUMN 26

Line 27, "fumerate," should read --fumarate,--.
Line 28, "erate," should read --arate,-- and "fumerate," (both occurrences) should read --fumarate,--.
Line 31, "glutarete" should read --glutarate--.
Line 41, "end" should read --and--.
Line 54, "n-buryl" should read --n-butyl--.

COLUMN 28

Line 4, "$(RO)_YH$" should read --$(RO)_Y$—H--.
Line 34, "fumetic" should read --fumaric--.
Line 35, "iraconic" should read --itaconic--.

COLUMN 29

Line 45, "valylate," should read --valerate,--.

COLUMN 30

Line 8, "acids" should read --acid--.
Line 21, "dibar-" should read --dicarboxylic--.
Line 22, "boxylic" should be deleted.

UNITED STATES PATENT AND TRADEMARK OFFICE

CERTIFICATE OF CORRECTION

PATENT NO. : 5,389,484

DATED : February 14, 1995

INVENTOR(S) : KAZUYOSHI HAGIWARA, ET AL.

It is certified that error appears in the above-identified patent and that said Letters Patent is hereby corrected as shown below:

COLUMN 31

Line 33, "melt-adhere" should read --melt-adheres--.
Line 34, "poop" should read --poor--.
Line 47, "$5\times10^3$" should read --$5\times10^3$,--.

COLUMN 33

Line 15, "matters" should read --matter--.
Line 23, "used used" should read --used--.
Line 58, "There," should read --There is,--.

COLUMN 36

Line 63, "Hanza" should read --Hansa--.

COLUMN 38

Line 33, "S1:" should read --$S_1$:-- and
"S2:" should read --$S_2$:--.
Line 64, "part the" should read --part of the--.

COLUMN 41

Line 17, "reacton" should read --reaction--.

COLUMN 42

Line 54, insert: --Example 2--.

UNITED STATES PATENT AND TRADEMARK OFFICE

CERTIFICATE OF CORRECTION

PATENT NO. : 5,389,484

DATED : February 14, 1995

INVENTOR(S) : KAZUYOSHI HAGIWARA, ET AL.

It is certified that error appears in the above-identified patent and that said Letters Patent is hereby corrected as shown below:

COLUMN 52

Line 11, "butylperoxyclohexyl)" should read --butylperoxycyclohexyl)--.

COLUMN 55

Line 43, "2,2-Azobisbutylonitrile)" should read --2,2-Azobis(butyronitrile)--.

COLUMN 58

Line 21, "1 parts" should read --1 part--.

COLUMN 60

Line 49, "10,000" should read --10,000th--.

COLUMN 61

Line 48, "low-temperature" should read --low-temperature,--.

COLUMN 66

Line 56, " c c " should read -- C C --.

COLUMN 67

Line 59, "Nigrogine" should read --Nigrosine--.

UNITED STATES PATENT AND TRADEMARK OFFICE

CERTIFICATE OF CORRECTION

PATENT NO. : 5,389,484

DATED : February 14, 1995

INVENTOR(S) : KAZUYOSHI HAGIWARA, ET AL.

It is certified that error appears in the above-identified patent and that said Letters Patent is hereby corrected as shown below:

COLUMN 68

Line 15, "10,000th" should read --5,000th--.
Line 25, "10,000th" should read --5,000th--.
Line 59, "and" should be deleted.

COLUMN 69

Line 10, "other;" should read --other; and--.
Line 26, "tuted" should read --tuted,--.

COLUMN 70

Line 12, "other;" should read --other; and--.
Line 41, "Formula (I);" should read --Formula (I):--.
Line 67, "ponent" should read --pound--.
Line 68, "(III);" should read --(III):--.

COLUMN 71

Line 23, "other;" should read --other; and--.

COLUMN 72

Line 41, "comprising;" should read --comprising:--.

COLUMN 73

Line 7, "and" should be deleted.
Line 27, "other;" should read --other; and--.
Line 62, "$_{ps}$" should be deleted.

UNITED STATES PATENT AND TRADEMARK OFFICE

CERTIFICATE OF CORRECTION

PATENT NO. : 5,389,484

DATED : February 14, 1995

INVENTOR(S) : KAZUYOSHI HAGIWARA, ET AL.

It is certified that error appears in the above-identified patent and that said Letters Patent is hereby corrected as shown below:

COLUMN 74

Line 29, "other;" should read --other; and--.
Line 56, "Formula (I);" should read --Formula (I):--.

COLUMN 75

Line 11, "component" should read --compound--.
Line 13, "(III);" should read --(III):--.
Line 35, "other;" should read --other; and--.
Line 59, "formed" should be deleted.

Signed and Sealed this

Tenth Day of October, 1995

Bruce Lehman

*Attest:*

BRUCE LEHMAN

*Attesting Officer*

*Commissioner of Patents and Trademarks*